US011384550B2

(12) United States Patent
McDonald et al.

(10) Patent No.: US 11,384,550 B2
(45) Date of Patent: Jul. 12, 2022

(54) PRE-FABRICATED SKELETAL FRAME FOR A ROOM

(71) Applicant: Modular Power Solutions, Inc., San Jose, CA (US)

(72) Inventors: Justin McDonald, Clay Center, KS (US); Michael Thomas Sweet, McKinney, TX (US); Simon Harkins, Prosper, TX (US)

(73) Assignee: Modular Power Solutions, Inc., San Jose, CA (US)

( * ) Notice: Subject to any disclaimer, the term of this patent is extended or adjusted under 35 U.S.C. 154(b) by 0 days.

(21) Appl. No.: 16/909,256

(22) Filed: Jun. 23, 2020

(65) Prior Publication Data

US 2020/0399917 A1 Dec. 24, 2020

Related U.S. Application Data

(60) Provisional application No. 62/865,774, filed on Jun. 24, 2019.

(51) Int. Cl.

| | |
|---|---|
| ***E04H 1/00*** | (2006.01) |
| ***E04H 1/12*** | (2006.01) |
| ***E04B 1/00*** | (2006.01) |

(52) U.S. Cl.

CPC ..... *E04H 1/005* (2013.01); *E04H 1/1205* (2013.01); *E04B 2001/0053* (2013.01)

(58) Field of Classification Search

CPC ..... E04H 1/005; E04H 1/04; E04B 1/34807; E04B 1/24

See application file for complete search history.

(56) References Cited

U.S. PATENT DOCUMENTS

| | | | | | |
|---|---|---|---|---|---|
| 2,499,498 | A * | 3/1950 | Hammond, Jr. | E04H 1/005 | 52/67 |
| 3,525,186 | A * | 8/1970 | Lombardo | E04H 6/18 | 52/125.6 |
| 3,541,744 | A * | 11/1970 | Maxwell | E04B 1/34807 | 52/73 |
| 3,623,296 | A * | 11/1971 | Santoro | E04B 1/34807 | 52/79.12 |
| 3,721,056 | A * | 3/1973 | Toan | E04B 1/34807 | 52/236.6 |
| 4,059,931 | A * | 11/1977 | Mongan | E04B 1/22 | 52/79.12 |
| 4,788,802 | A * | 12/1988 | Wokas | A47K 4/00 | 52/34 |
| 5,528,866 | A * | 6/1996 | Yulkowski | E04H 1/04 | 52/79.12 |
| 9,663,937 | B2 * | 5/2017 | Goldman | E04B 1/3483 | |

(Continued)

*Primary Examiner* — Gisele D Ford
(74) *Attorney, Agent, or Firm* — Rutan & Tucker, LLP

(57) ABSTRACT

A pre-fabricated and pre-engineered integrated skeletal frame for a room is discussed. In an embodiment, the pre-fabricated and pre-engineered integrated skeletal frame is for an electrical room with its electrical equipment installed, wired up, and tested offsite in a factory. The pre-fabricated and pre-engineered integrated skeletal frame can have rigging components such as lifting eye hooks and temporary structural cross connect bracing for rigging. The prefabricated room can have electrical equipment mounted inside, wired up, and tested off site at the factory and then be shipped to the construction site.

20 Claims, 35 Drawing Sheets

(56) References Cited

U.S. PATENT DOCUMENTS

| | | | | |
|---|---|---|---|---|
| 10,711,476 | B2 * | 7/2020 | Ansari | E04H 5/02 |
| 2003/0101680 | A1 * | 6/2003 | Lee | E04H 1/04 52/745.2 |
| 2014/0115976 | A1 * | 5/2014 | Lippert | E04H 1/005 52/79.2 |

* cited by examiner

Figure 13 Raised floor pre-formed metal section cross connect section connecting between
two raised floor
pre-formed metal sections Figure 16 Cross connect section Figure 17 Top Cross connect section

100

A scaled raised floor with two sets of four pre-formed metal sections each all bolted together

100

Figure 24 Corner support bracket for adjoining wall sections

Figure 25 Seem support bracket for adjoining wall sections

100

Figure 27 EXPLODED VIEW

100

10' X 10' WALL PANEL ASSEMBLY

100

EXPLODED VIEW

10' X 10' WALL PANEL ASSEMBLY
WITH 36" X 84" FIRE RATED DOOR

Figure 32 10' X 9' 2" WALL PANEL ASSEMBLY

BASE FRAME
WITH RAISED FLOOR AND INFILL FLOOR PLATES

PRE-FABRICATED SKELETAL FRAME FOR A ROOM

RELATED APPLICATION

This application claims priority to and the benefit of under 35 USC 119 of U.S. provisional patent application titled "A pre-fabricated skeletal frame for a room," filed Jun. 24, 2019, Ser. No. 62/865,774, which is incorporated herein by reference in its entirety.

FIELD OF THE INVENTION

Embodiments of the invention generally relate to a pre-fabricated and pre-engineered integrated platform for a room that can be easily assembled on site, is scalable, and is modular.

BACKGROUND OF THE INVENTION

Construction projects proceed in stages because certain aspects of the project must be completed prior to the next stage being initiated. However, the traditional stages of constructing a building can be altered with some creative thinking.

SUMMARY

A pre-fabricated and pre-engineered integrated skeletal frame for a room is discussed. In an embodiment, the pre-fabricated and pre-engineered integrated skeletal frame is for an electrical room with its electrical equipment installed, wired up, and tested offsite in a factory. The pre-fabricated and pre-engineered integrated skeletal frame can have rigging components such as lifting eye hooks and temporary structural cross connect bracing for rigging. The prefabricated room can have electrical equipment mounted inside, wired up, and tested off site at the factory and then be shipped to the construction site.

These and other features of the design provided herein can be better understood with reference to the drawings, description, and claims, all of which form the disclosure of this patent application.

BRIEF DESCRIPTION OF THE DRAWINGS

The drawings refer to some embodiments of the design provided herein in which.

Figure 1:
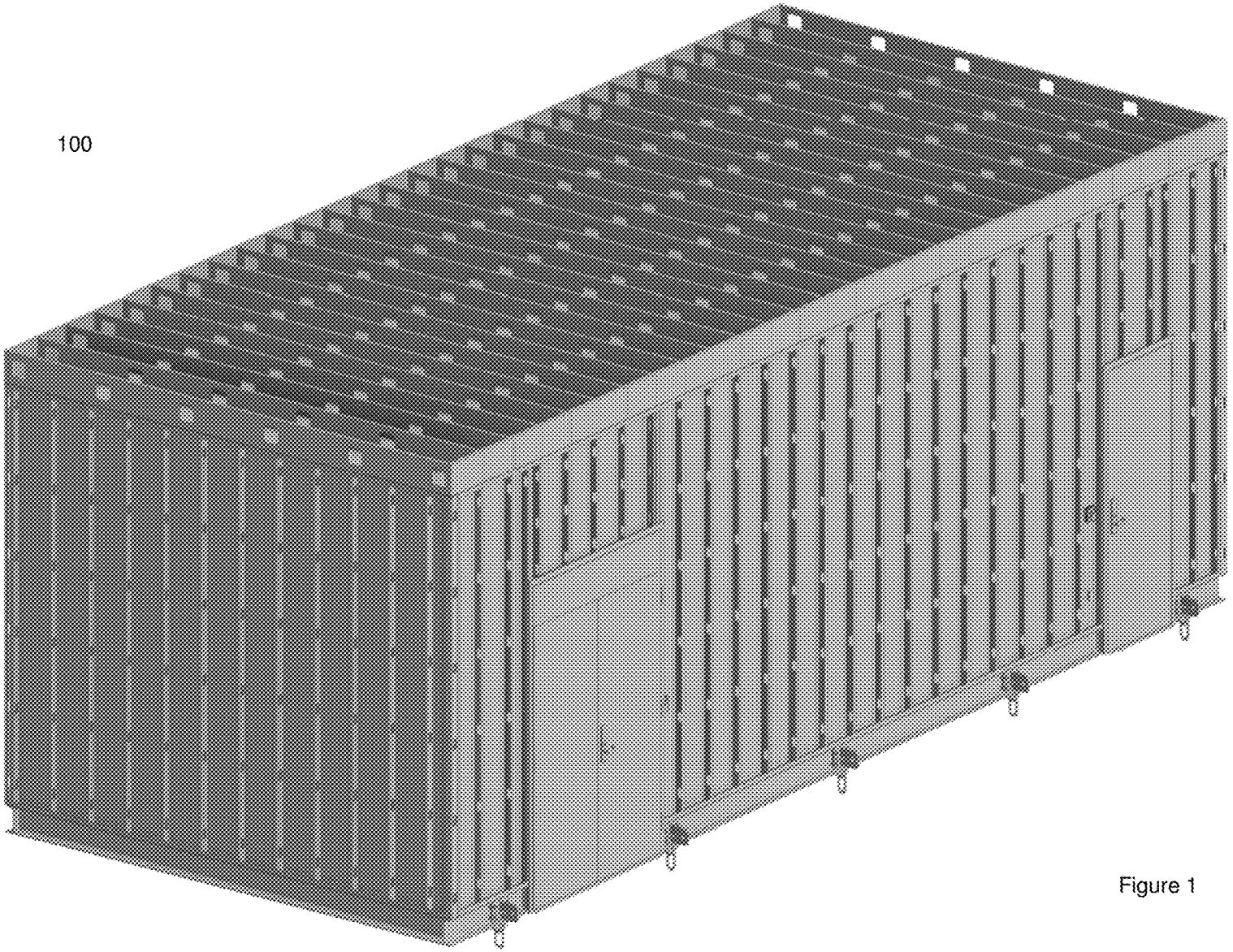
FIG. 1 illustrates a block diagram of an embodiment of an assembled pre-fabricated and pre-engineered integrated skeletal frame for a room with multiple skeletal sections that have a door and its door frame on a single side of the integrated skeletal frame for the room.

While the invention is subject to various modifications and alternative forms, specific embodiments thereof have been shown by way of example in the drawings and will herein be described in detail. The invention should be understood to not be limited to the particular forms disclosed, but on the contrary, the intention is to cover all modifications, equivalents, and alternatives falling within the spirit and scope of the invention.

DETAILED DISCUSSION

In the following description, numerous specific details are set forth, such as examples of specific data signals, named components, connections, amount of power supplies, etc., in order to provide a thorough understanding of the present invention. It will be apparent, however, to one of ordinary skill in the art that the present invention may be practiced without these specific details. In other instances, well known components or methods have not been described in detail but rather in a block diagram in order to avoid unnecessarily obscuring the present invention. Further specific numeric references such as first enclosure, may be made. However, the specific numeric reference should not be interpreted as a literal sequential order but rather interpreted that the first enclosure is different than a second enclosure. Thus, the specific details set forth are merely exemplary. The specific details may be varied from and still be contemplated to be within the spirit and scope of the present invention.

In general, a pre-fabricated and pre-engineered integrated skeletal frame for a room that comes to a work site in easily shippable modular sections that are easily assembled and scalable is described. This provides for a faster delivery and construction of interior rooms in a building such as a data center.

Figure 11:
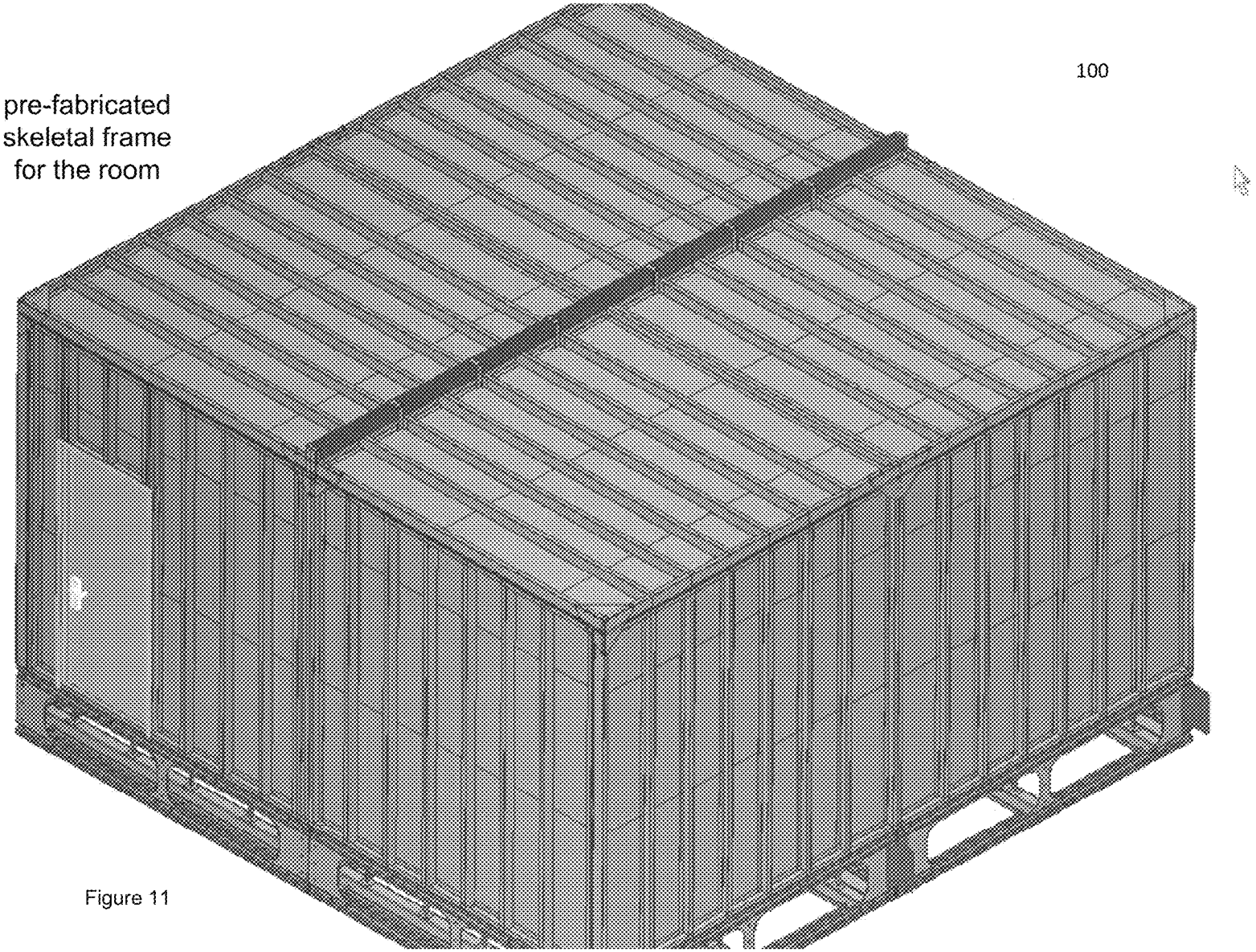
FIG. 11 illustrates a block diagram of an embodiment of a pre-fabricated and pre-engineered integrated skeletal frame for a room that comes to a work site in one or more shippable modular sections that are then easily assembled together to form a complete room ready to be rigged into place into a building being built.

FIG. 11 illustrates a block diagram of an embodiment of a pre-fabricated and pre-engineered integrated skeletal frame 100 for a room that comes to a work site in one or more shippable modular sections that are then easily assembled together to form a complete room ready to be rigged into place into a building being built. (See also for example FIGS. 1 and 26.) FIG. 27 illustrates an exploded view of an embodiment of a pre-fabricated and pre-engineered integrated skeletal frame 100 for a room. The pre-fabricated skeletal frame 100 for the room has pre-fabricated base raised floor sections, pre-fabricated wall sections, and pre-fabricated ceiling sections, which all are manufactured in standardize sections and lengths. Each component part is a pre-fabricated building block that can come in standard lengths sizes. Thus, the pre-fabricated components, such as the raised floor, cross connect beams, walls, ceilings, etc. can come in standard lengths such as 4 foot, 5 foot, and 10 foot with pre-fabricated bolt holes and markings for screws/bolts. (See for example FIG. 19) This allows for virtually any sized room to be 95% assemble with these pre-fabricated sections and then just that little last bit of the room to be custom built. However, merely that last section is tailored to the exact dimensions of the room for that building. The rest of the room components have been both pre-engineered and pre-fabricated to match in shape and connections while also easily securing with each other. This allows for virtually any sized room to be assembled on site quite quickly. Moreover, in a lot of situations, one or more complete portions of the room can be fully built and assembled with equipment installed, wired up, and tested offsite at a factory and then shipped to the construction site to be assembled into the complete room with exterior walls and lighting already installed.

Figure 14:
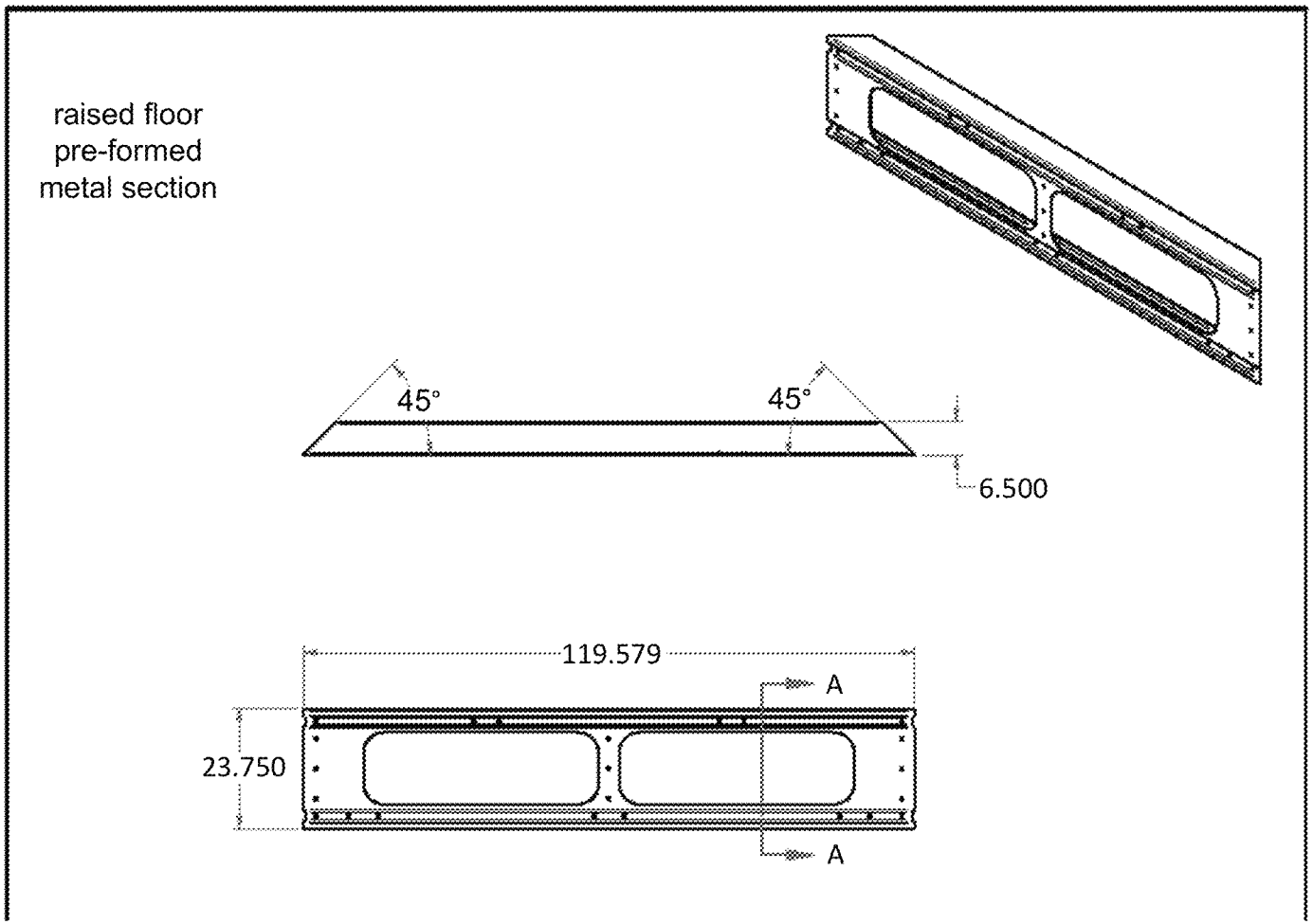
FIG. 14 illustrates a diagram of an embodiment of a pre-formed metal joist for a raised floor section of the pre-fabricated and pre-engineered skeletal frame for a room.
Figure 29:
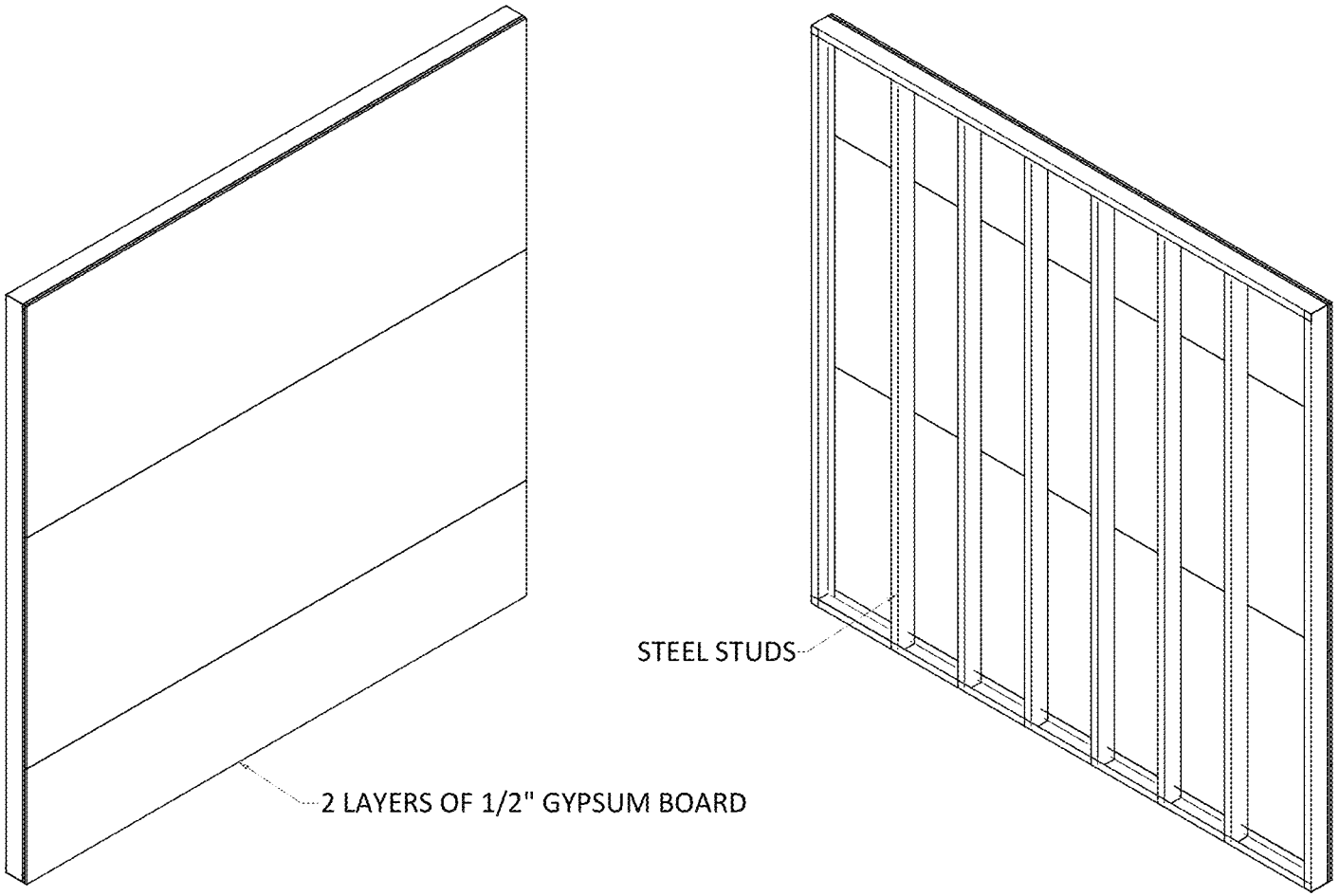
FIG. 29 illustrates a block diagram of an embodiment of an inside of a wall panel assembly on the right side and a gypsum board wall panel on the left side to attach to the pre-fabricated and pre-engineered skeletal frame for the room.

Again, the different lengths can be assembled to make up different sized rooms. For example, two 4 foot sections and a 10 section can be bolted together for the raised floor sections to make the base for an 18' by 18' room, with then corresponding two 4 foot sections and a 10 section of walls and ceilings. See, for example, FIG. 29 illustrates a block diagram of an embodiment of an inside of a, for example 10×10, wall panel assembly on the right side and a gypsum board wall panel on the left side to attach to the pre-fabricated and pre-engineered skeletal frame 100 for the room. Likewise, three 5 foot sections and a 4 section can be bolted together for the raised floor sections to make the base for a 19' by 19' room, with then corresponding three 5 foot sections and a 4 foot section of walls and ceilings. See, for example, FIG. 14 illustrates a diagram of an embodiment of a pre-formed metal joist for a raised floor section of the pre-fabricated and pre-engineered skeletal frame 100 for a room. The different sections can easily align to each other due to the pre-engineering in order to bolt them together to form the skeletal frame 100 for the room as well as allow sections of the walls and ceilings to screw together. The modularity allows rooms of almost any dimension to be quickly assembled on the work site or at the factory.

Figure 31:
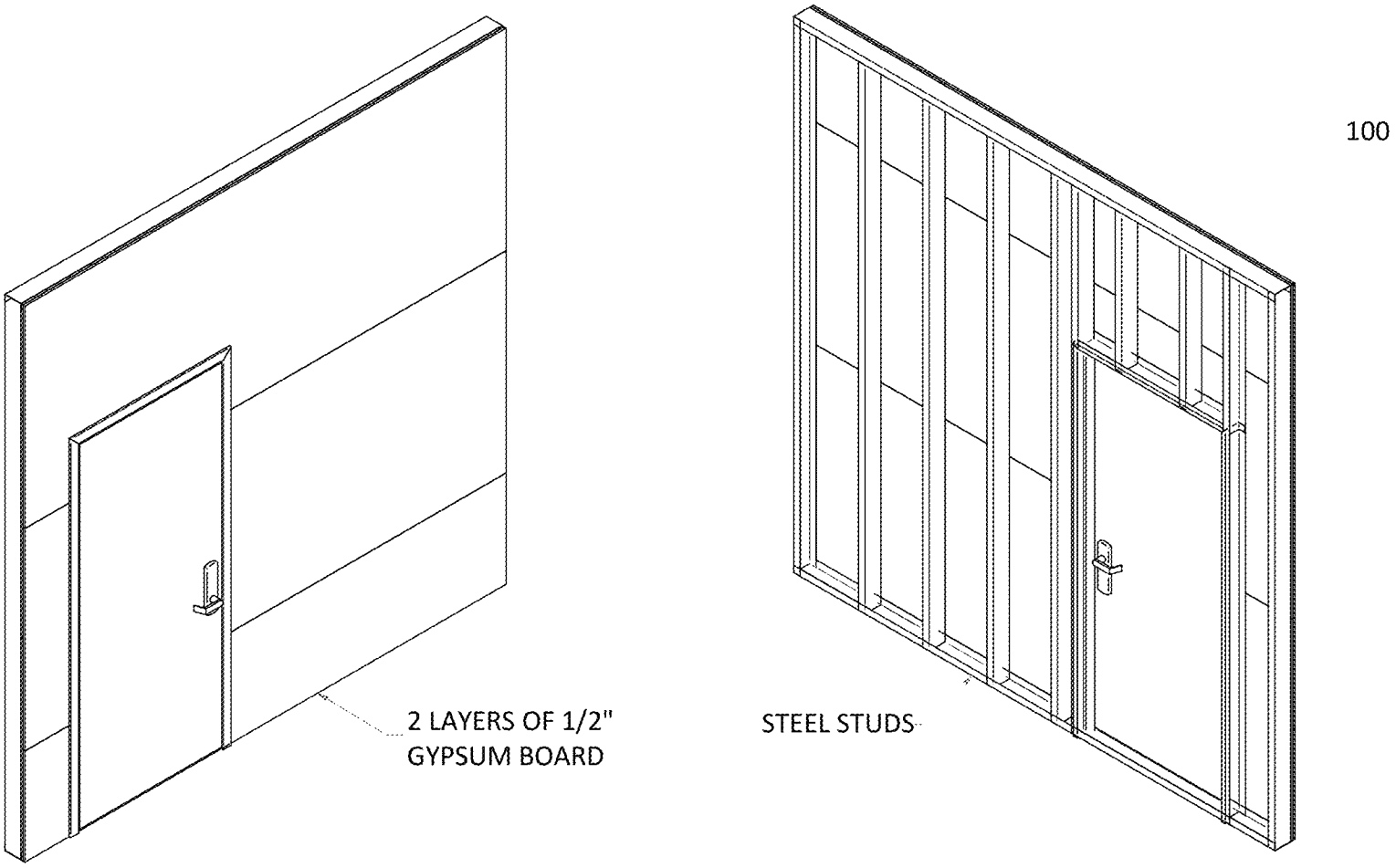
FIG. 31 illustrates a block diagram of an embodiment of the wall frame section with its struts and a door frame in that frame section forming a portion of the pre-fabricated and pre-engineered skeletal frame for a room on the right hand side and the example gypsum wall attached to that wall frame section on the left hand side.

FIG. 31 illustrates a block diagram of an embodiment of the wall frame section with its struts and a door frame in that frame section forming a portion of the pre-fabricated and pre-engineered skeletal frame 100 for a room on the right hand side and the example gypsum wall attached to that wall frame section on the left hand side. The parts, the raised floor, cross connect beams, walls, ceilings, etc. can be symmetrical and/or mirrored with respect to each other. Note, the prefabricated room has attachments for a raised floor to connect to the rest of the skeletal framework 100 but need not have a raised floor.

Figure 12:
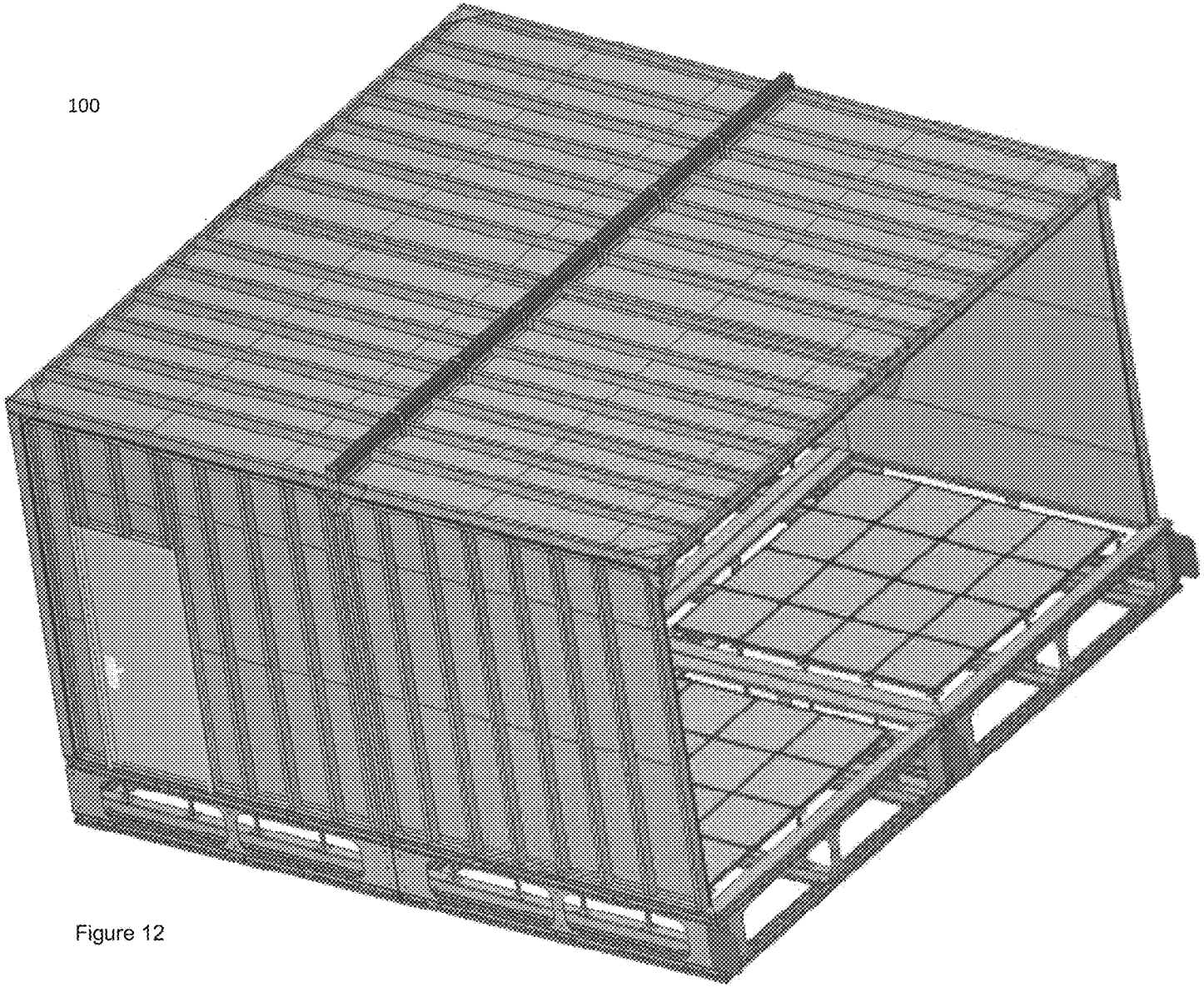
FIG. 12 illustrates a block diagram of an embodiment of a pre-fabricated and pre-engineered integrated skeletal frame for a room with one of the walls removed to show its interior and an optional raised floor attached to the skeletal frame for the room.

FIG. 12 illustrates a block diagram of an embodiment of a pre-fabricated and pre-engineered integrated skeletal frame 100 for a room with one of the walls removed to show its interior and an optional raised floor attached to the skeletal frame 100 for the room. The pre-fabricated skeletal frame 100 for the room can be used to form one or more interior rooms of a building. However, unlike standard wooden stick build constructions of interior rooms, the vast majority of the sections of the skeletal frame 100 making up this entire room are pre-fabricated and pre-engineered frame for a room in an offsite manufacturing center, in standardized lengths, shapes, geometries, and components to all precisely fit together to form the majority of the interior room so they merely need to be bolted and screwed together. This allows the room to be built quite a bit faster with more cohesion amongst the floor, the walls, and ceiling. The pre-engineered and pre-fabricated forming the framework of a room are made of metal such as steel, iron, etc.

Figure 23:
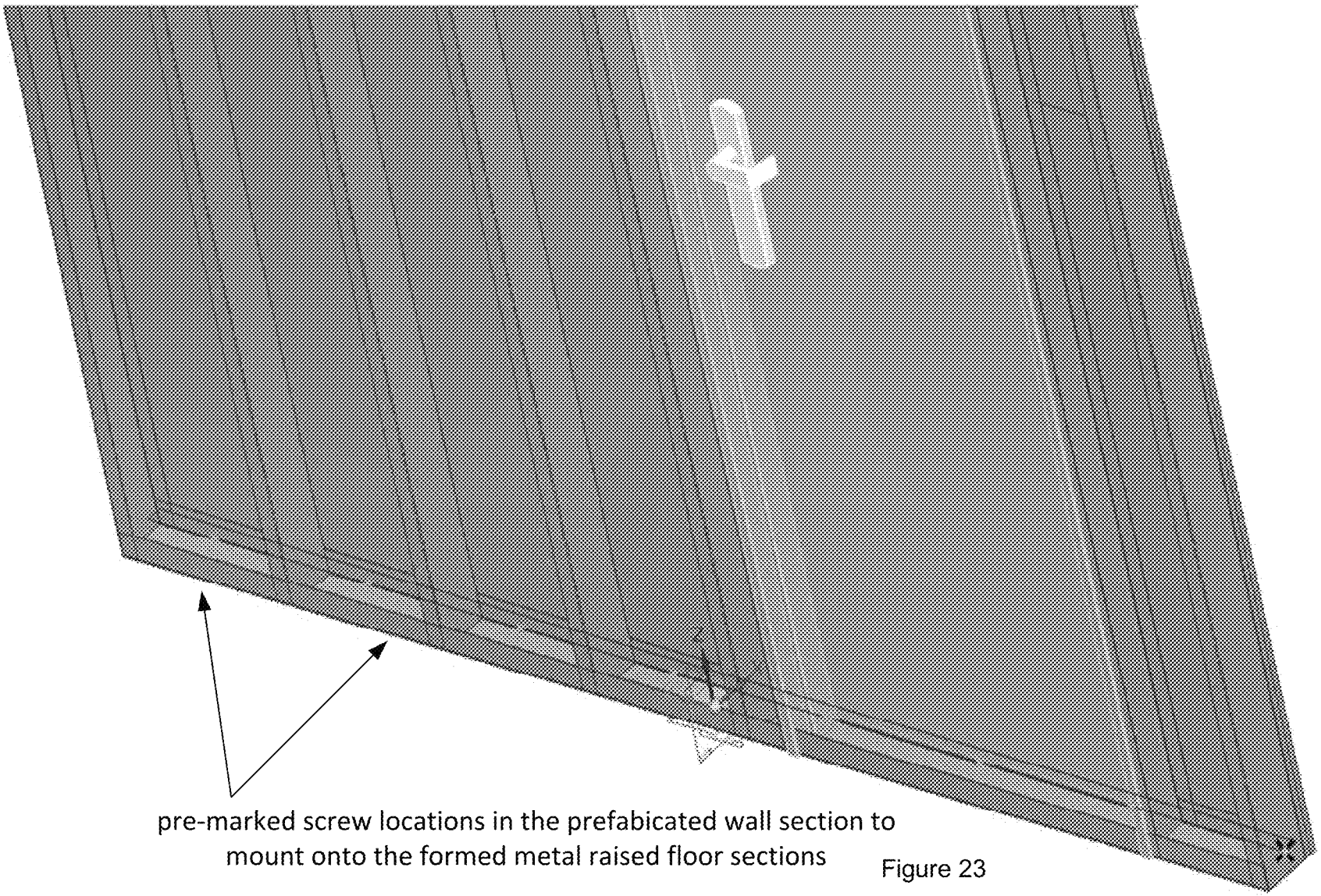
FIG. 23 illustrates a block diagram of an embodiment of pre-marked screw locations in the pre-fabricated wall section to secure and join the formed metal raised floor sections for the skeletal frame for a room to the wall section of the skeletal frame.
Figure 24:
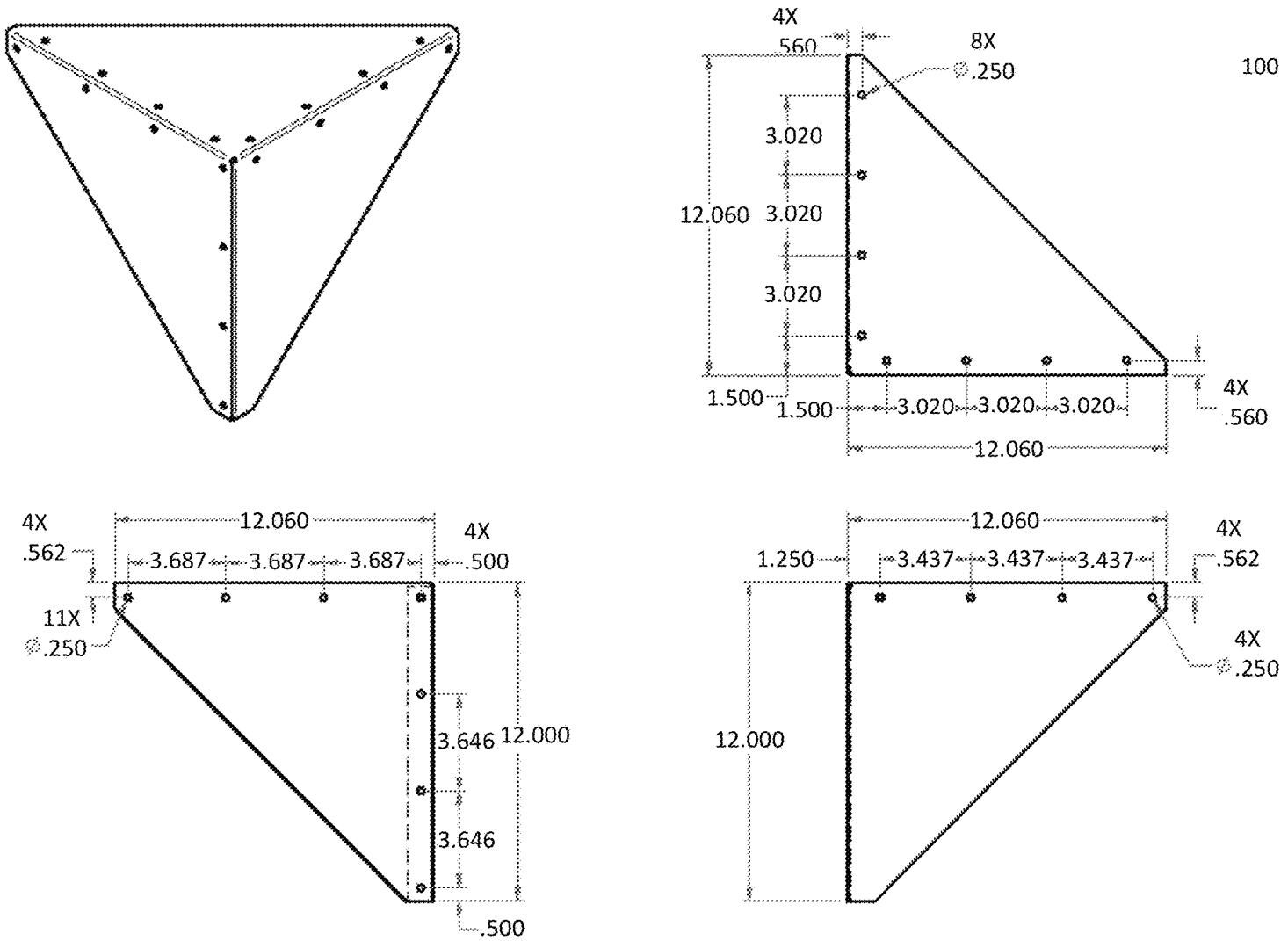
FIG. 24 illustrates a diagram of an embodiment of a corner support bracket for adjoining wall sections of the pre-fabricated and pre-engineered integrated skeletal frame for a room.
Figure 25:
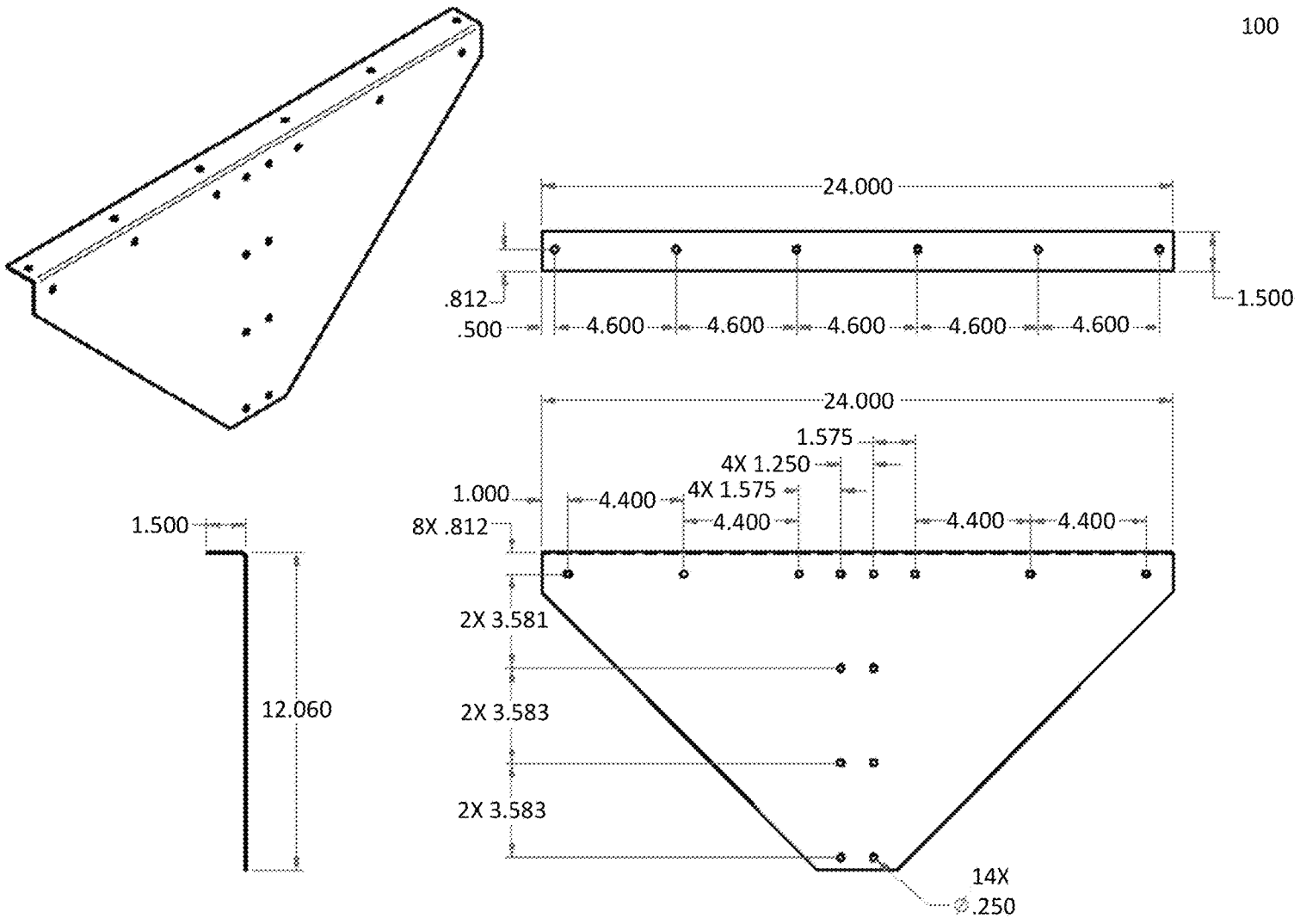
FIG. 25 illustrates a diagram of an embodiment of a seem support bracket for adjoining wall sections for the pre-fabricated and pre-engineered integrated skeletal frame for a room.
Figure 26:
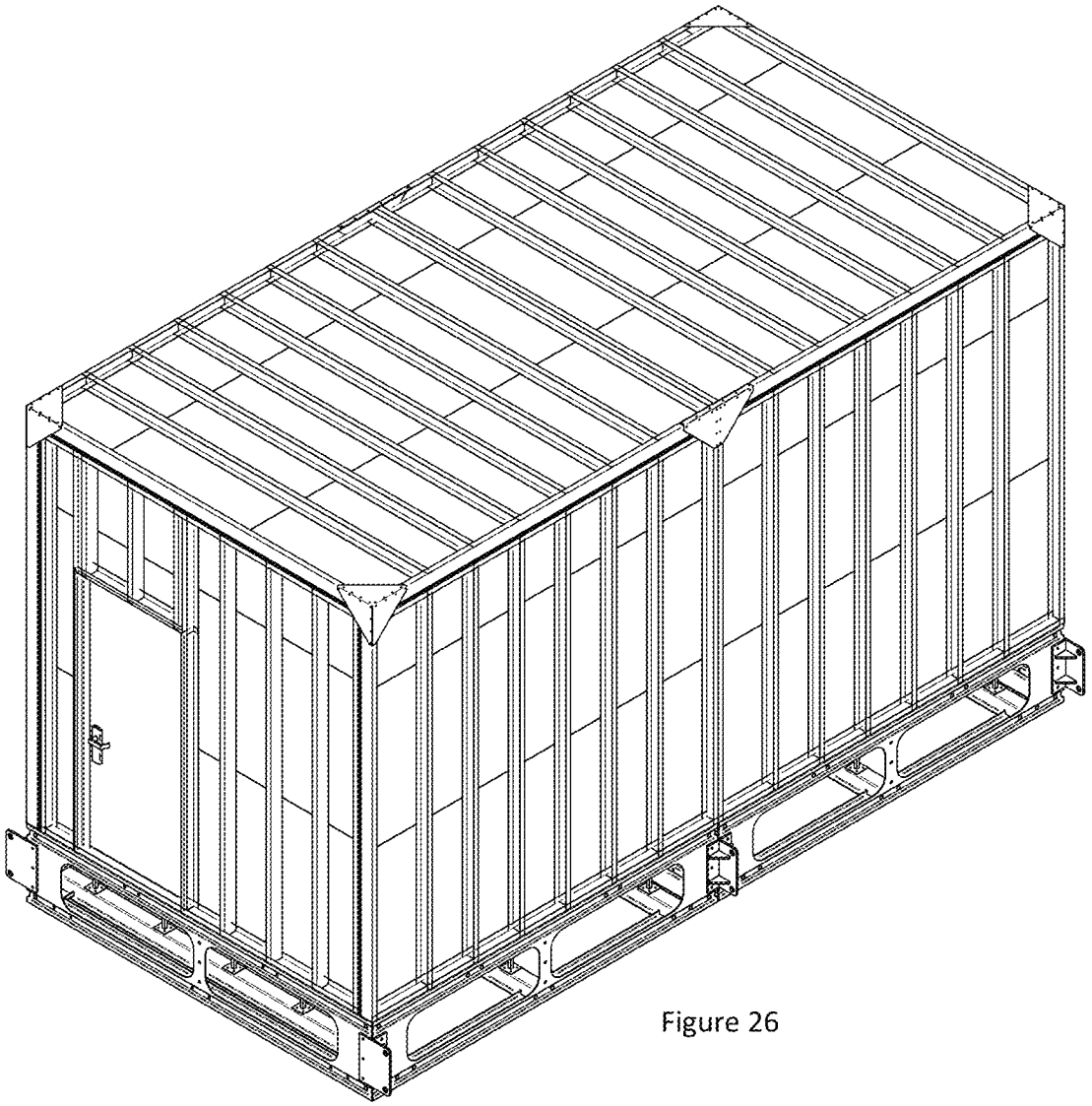
FIG. 26 illustrates a block diagram of an embodiment of an assembled pre-fabricated and pre-engineered integrated skeletal frame for a room with its adjoining brackets between wall sections of the skeletal frame.
Figure 27:
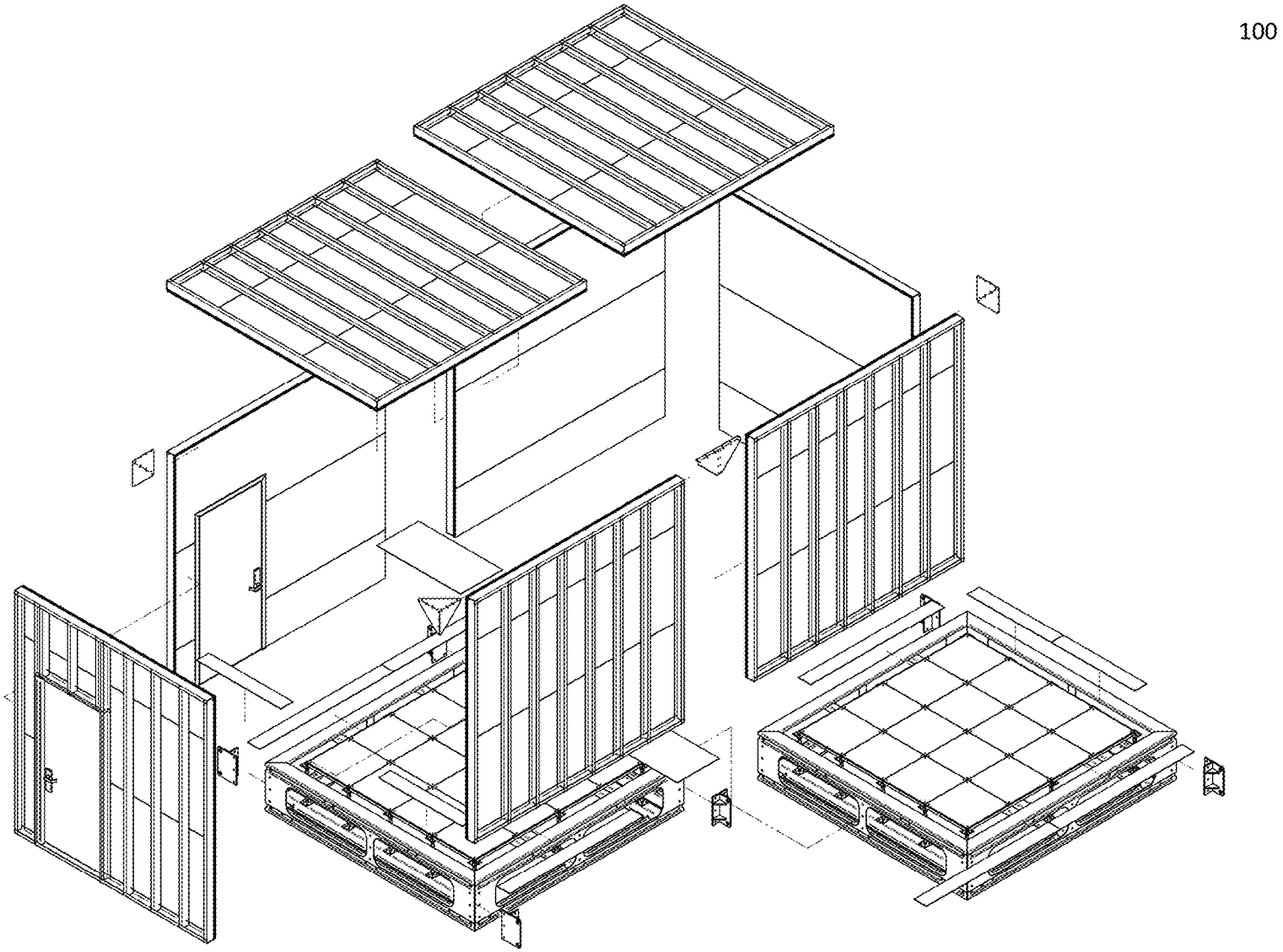
FIG. 27 illustrates an exploded view of an embodiment of a pre-fabricated and pre-engineered integrated skeletal frame for a room.

FIG. 26 illustrates a block diagram of an embodiment of an assembled pre-fabricated and pre-engineered integrated skeletal frame 100 for a room with its adjoining brackets between wall sections of the skeletal frame 100. FIG. 23 illustrates a block diagram of an embodiment of pre-marked screw and/or bolt locations in the pre-fabricated wall section to secure and join the formed metal raised floor sections for the skeletal frame 100 for a room to the wall section of the skeletal frame 100. FIG. 24 illustrates a diagram of an embodiment of a corner support bracket for adjoining wall sections of the pre-fabricated and pre-engineered integrated skeletal frame 100 for a room. FIG. 25 illustrates a diagram of an embodiment of a seem support bracket for adjoining wall sections for the pre-fabricated and pre-engineered integrated skeletal frame 100 for a room.

Raised Floor Sections

Figure 20:
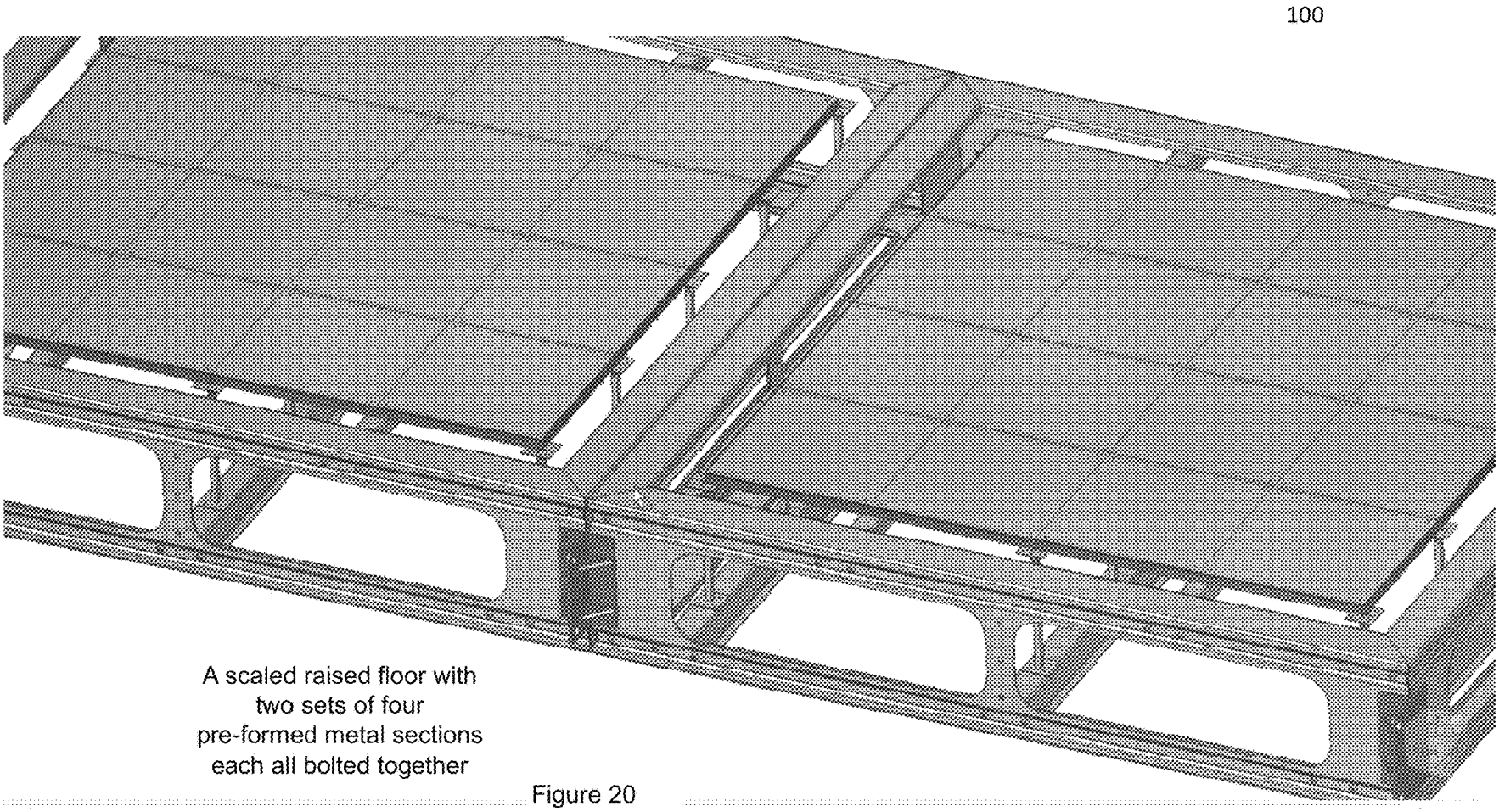
FIG. 20 illustrates a block diagram of an embodiment of a scalable raised floor with two sets of four pre-formed metal sections each all bolted together in the pre-fabricated and pre-engineered integrated skeletal frame for a room.
Figure 21:
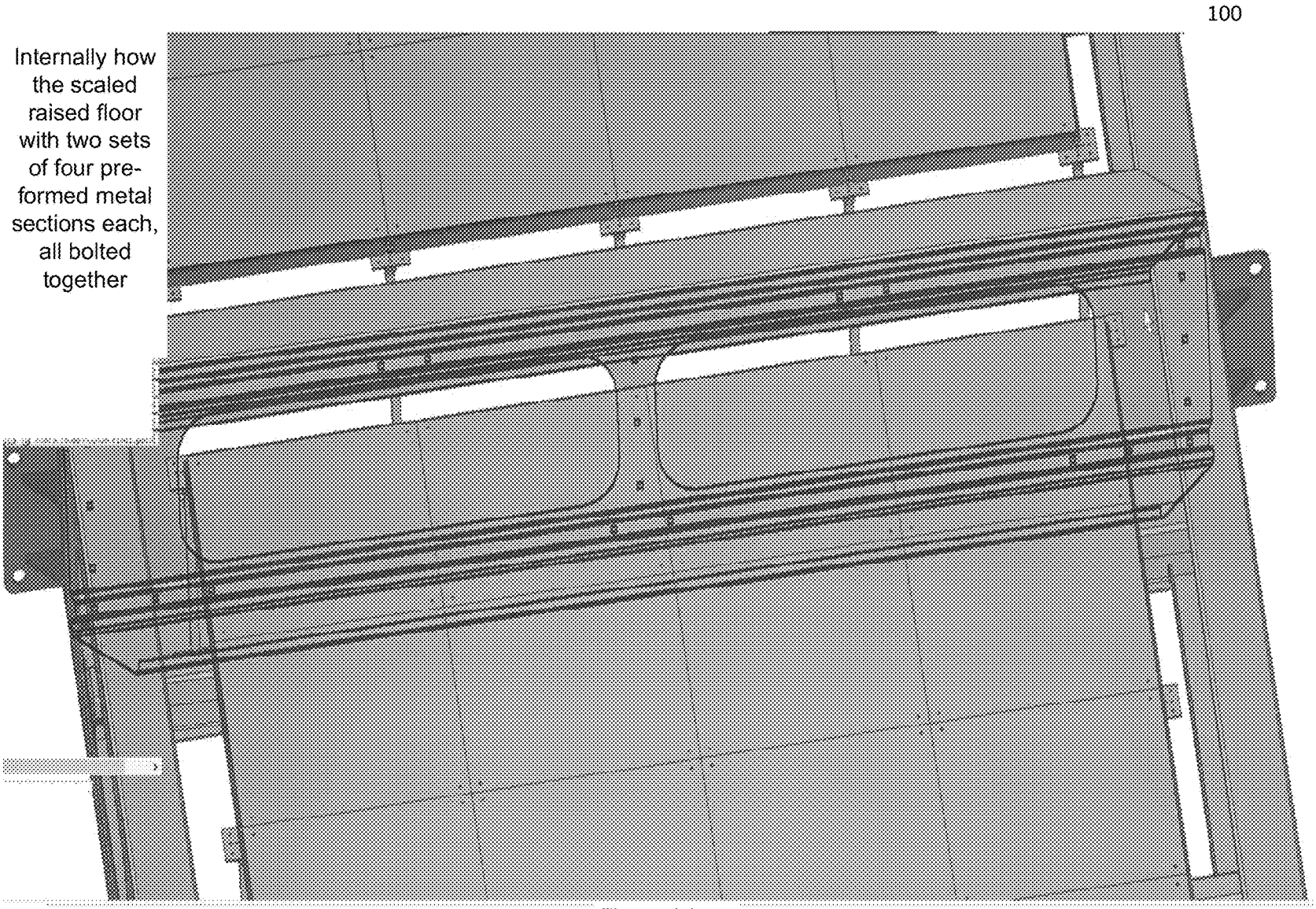
FIG. 21 illustrates a block diagram of an embodiment of internally how the raised floor with two sets of four pre-formed metal sections each, all bolted together for the pre-fabricated and pre-engineered integrated skeletal frame for a room. The shaded sections where the preformed metal sections mate and bolt up are highlighted with the shading.
Figure 28:
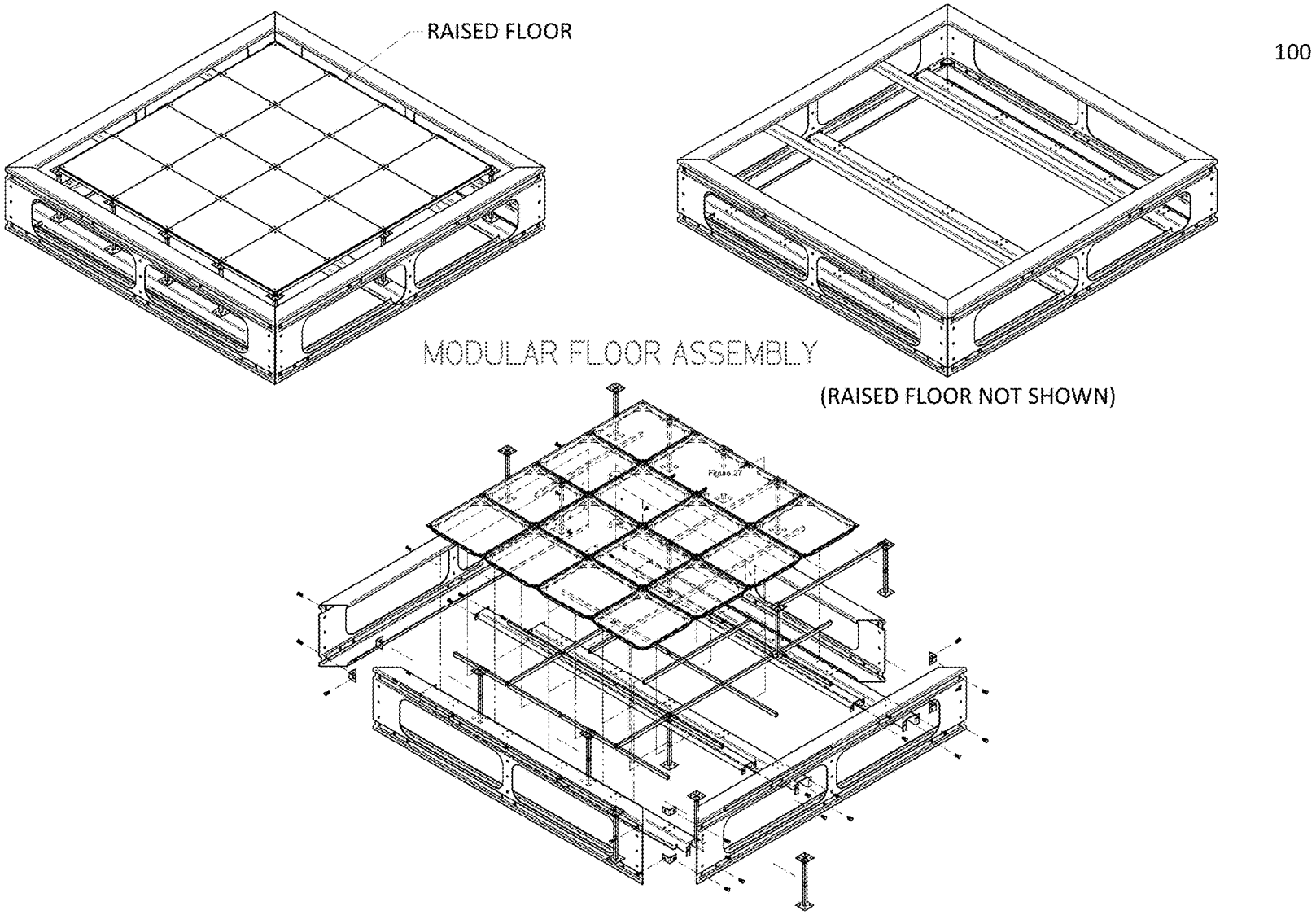
FIG. 28 illustrates an exploded view of an embodiment of a raised floor section in relation to the assembled raised floor section shown on the upper right and the assembled raised floor section with flooring tiles shown on the upper left.

FIG. 20 illustrates a block diagram of an embodiment of a scalable raised floor with two sets of four pre-formed metal sections each all bolted together in the pre-fabricated and pre-engineered integrated skeletal frame 100 for a room. FIG. 21 illustrates a block diagram of an embodiment of internally how the raised floor with two sets of four pre-formed metal sections each, all bolted together for the pre-fabricated and pre-engineered integrated skeletal frame 100 for a room. The shaded sections where the preformed metal sections mate and bolt up are highlighted with the shading. FIG. 28 illustrates an exploded view of an embodiment of a raised floor section in relation to the assembled raised floor section shown on the upper right and the assembled raised floor section with flooring tiles shown on the upper left. The raised floor is made out of pre-formed metal sections. These pre-formed metal sections are formed panels with diagonal corners. Four of these pre-formed metal sections can meet at the corners to form into a rectangular shape. These pre-formed metal sections have pre-drilled bolt holes for connections to aligned bolt holes of adjoining/abutting sections. The pre-drilled bolt hole on the exterior of the panel where the carriage bolt goes through is precise and tight; whereas, the bolt hole on the interior section being adjoined is a little bigger and sloppier (e.g.

larger) in the size of the hole so that these two sections can be aligned and mated together slightly easier.

Figure 13:
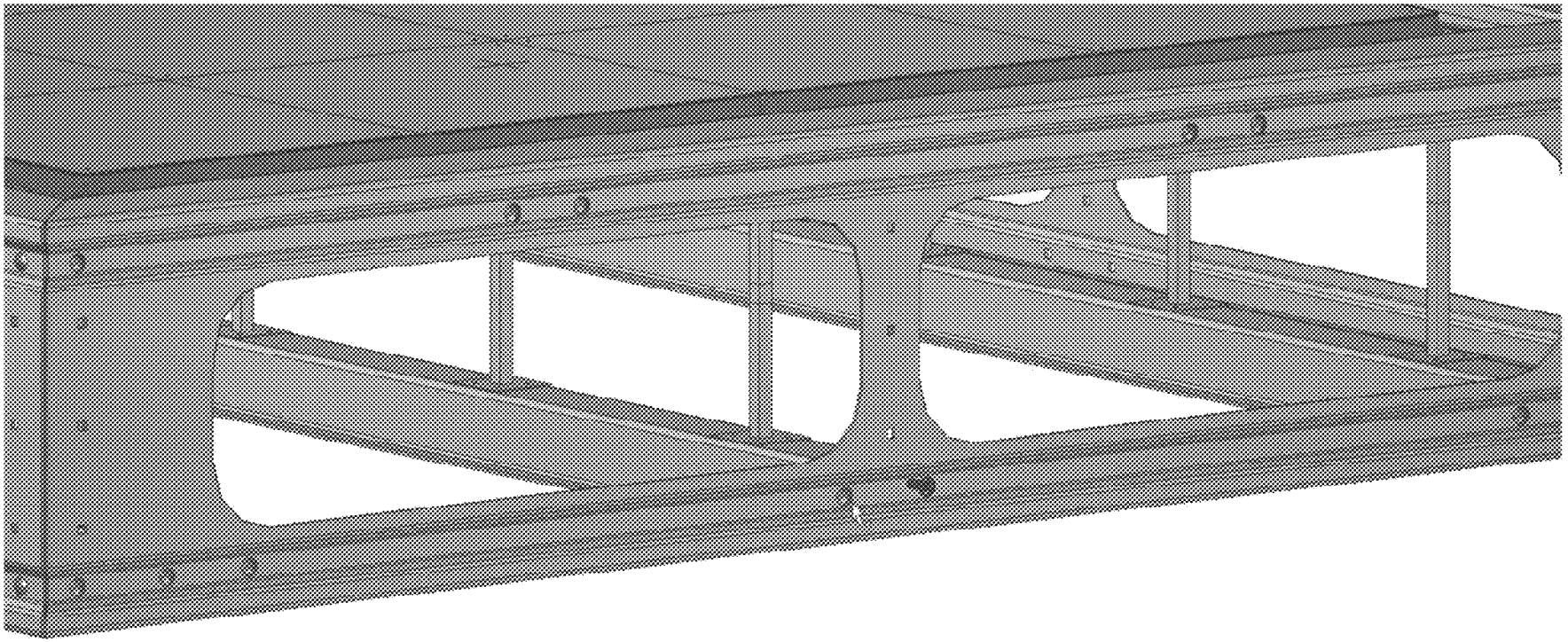
FIG. 13 illustrates a block diagram of an embodiment of a pre-formed metal section of the raised floor for the skeletal frame for the room.
Figure 15:
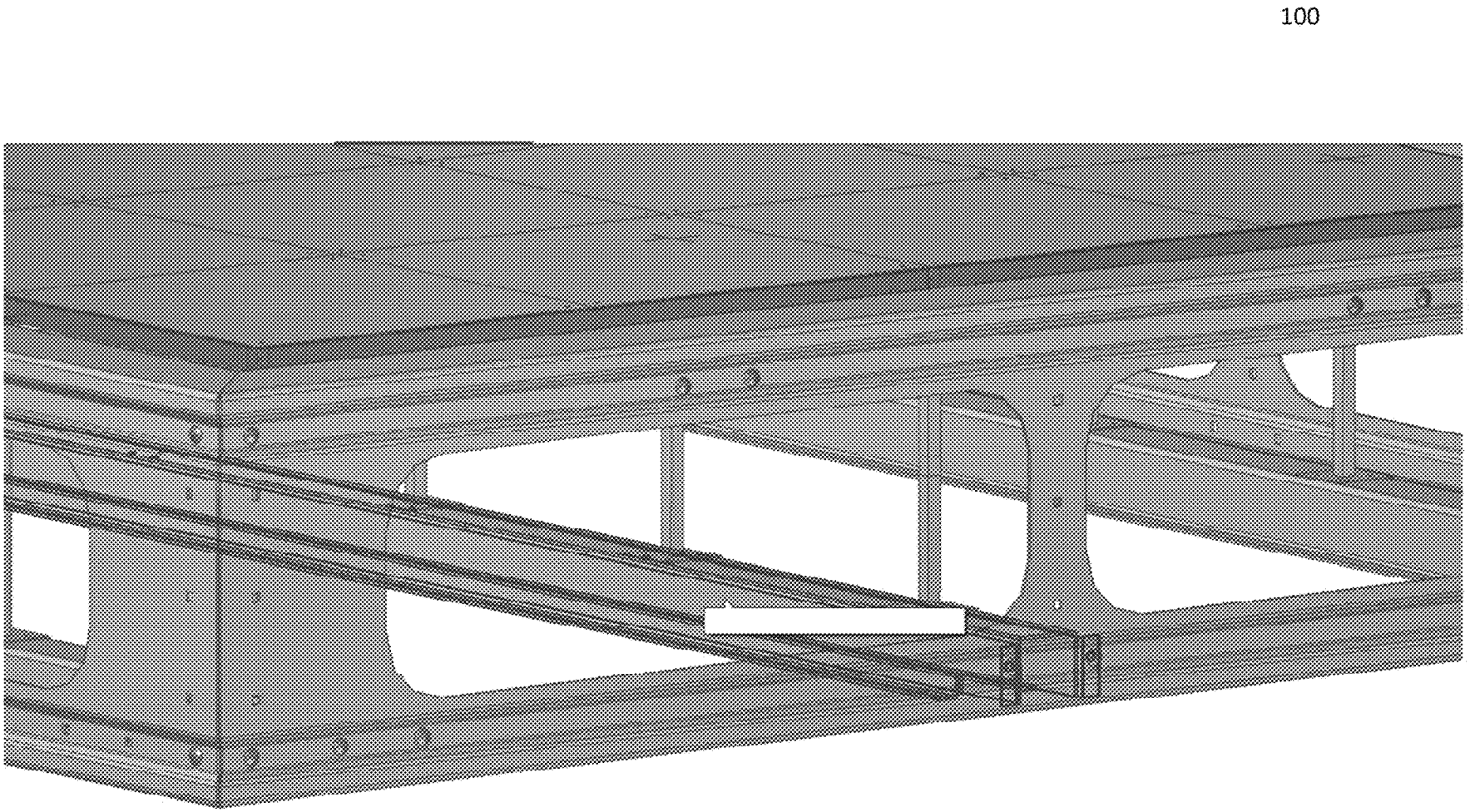
FIG. 15 illustrates a block diagram of an embodiment of a cross connect section connecting between two raised floor pre-formed metal sections pre-fabricated and pre-engineered integrated skeletal frame for a room
Figure 16:
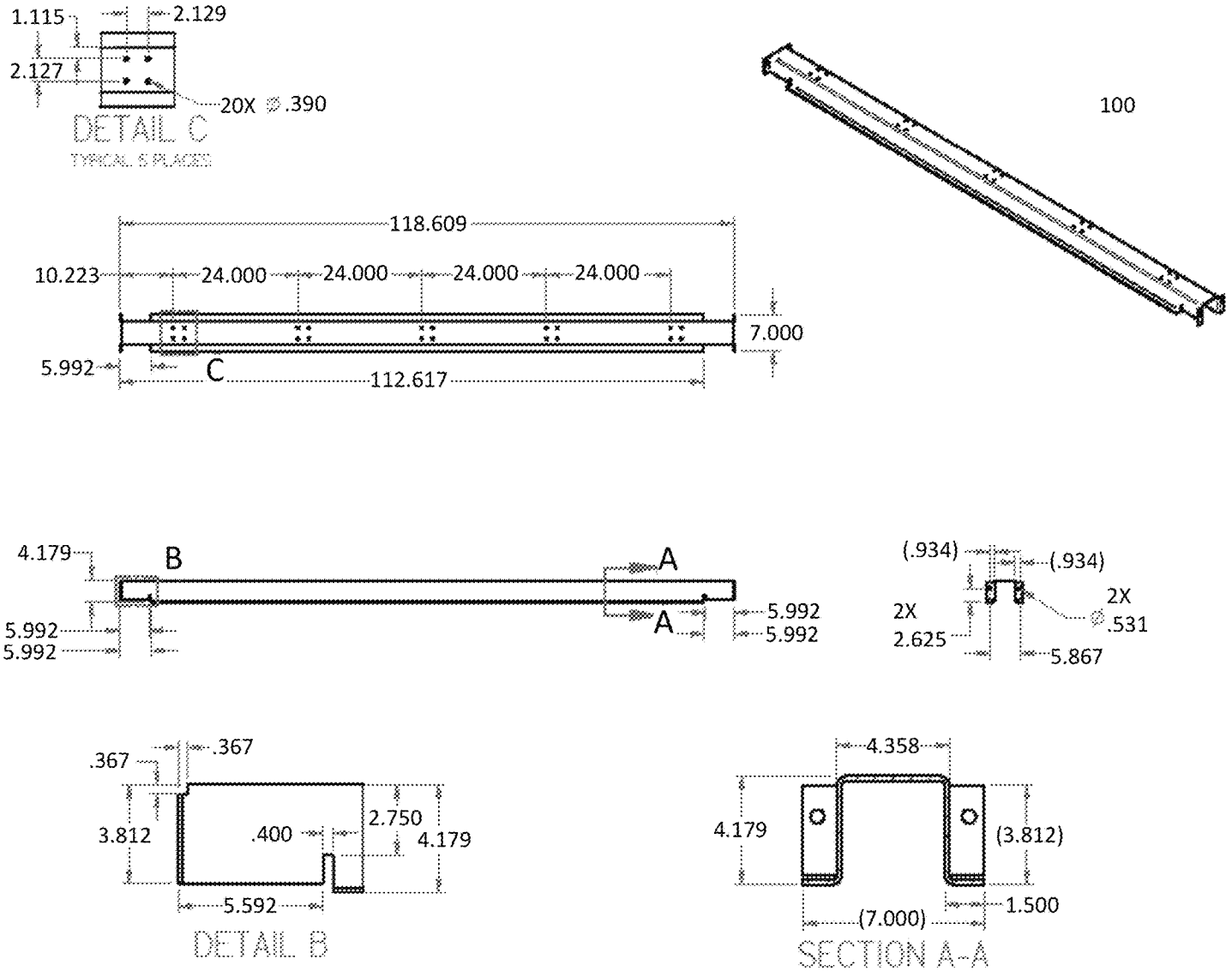
FIG. 16 illustrates a diagram of an embodiment of a cross connect beam to structurally support the pre-fabricated and pre-engineered integrated skeletal frame for a room.
Figure 19:
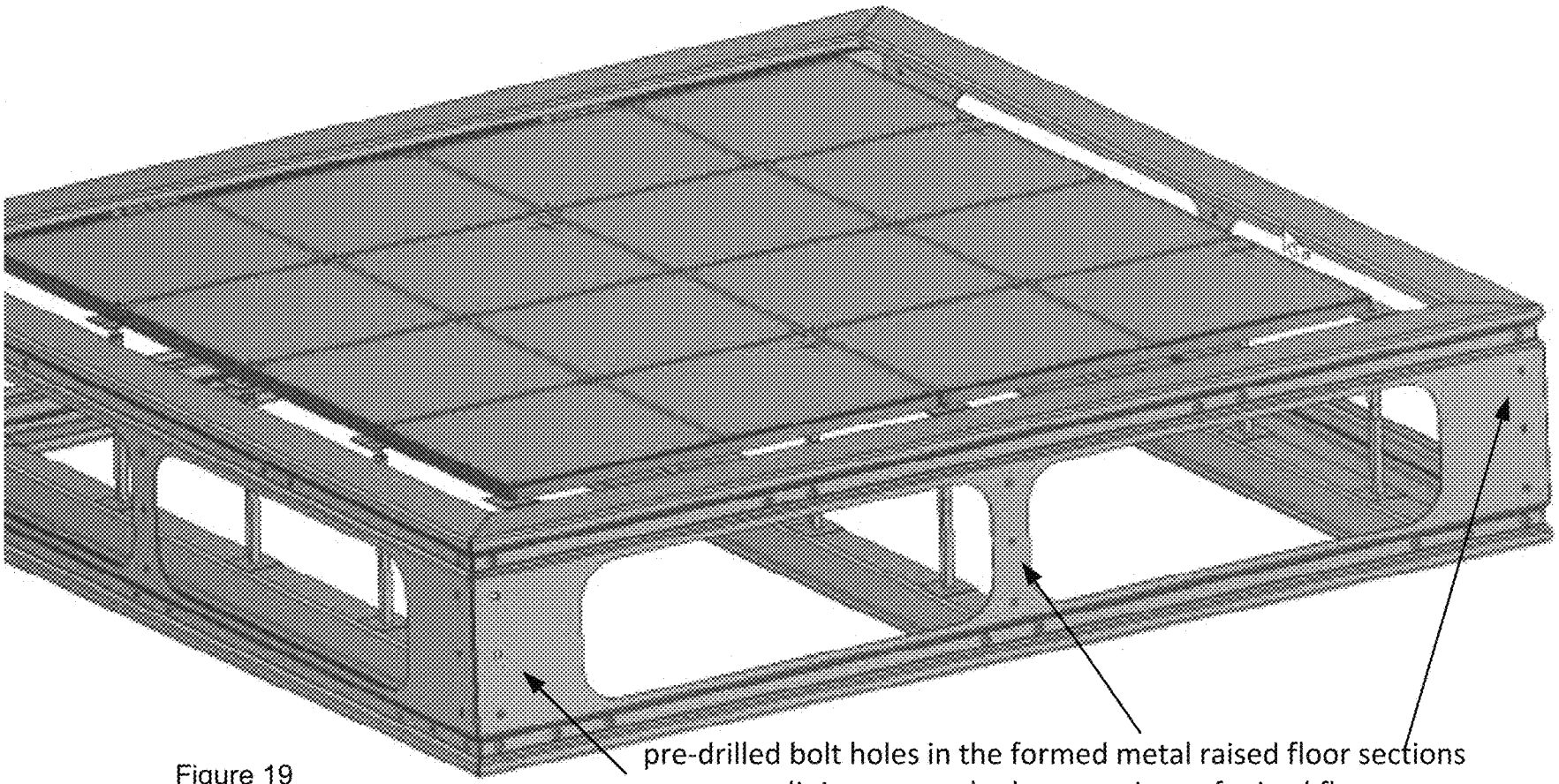
FIG. 19 illustrates a block diagram of an embodiment of pre-drilled bolt holes in the formed metal raised floor sections to adjoin rectangular base sections of raised floor the pre-fabricated and pre-engineered integrated skeletal frame for a room.
Figure 22:
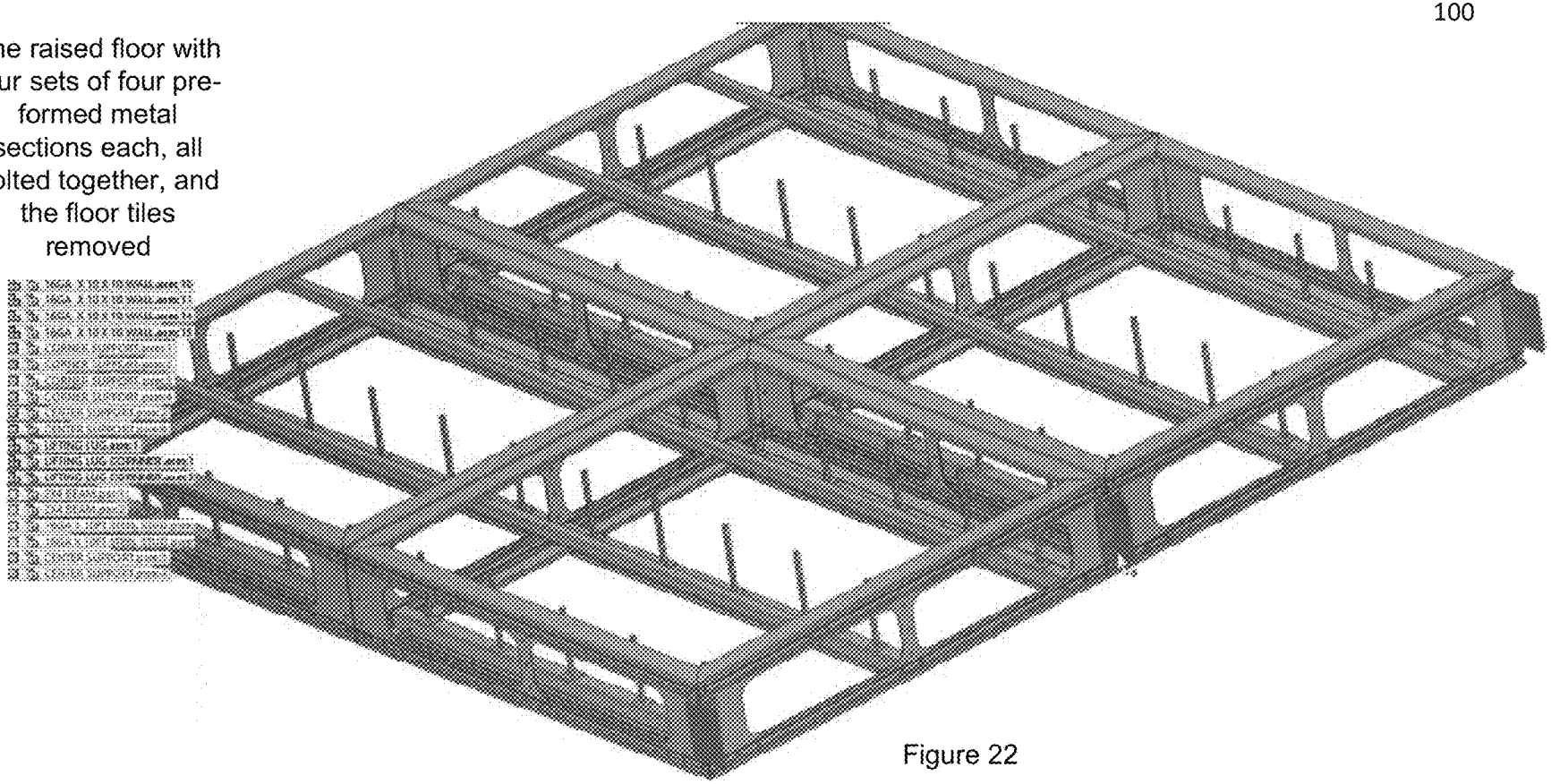
FIG. 22 illustrates a block diagram of an embodiment of a raised floor with four sets of four preformed metal sections each all bolted together, and with the floor tiles removed for the integrated skeletal frame for the room.

FIG. 22 illustrates a block diagram of an embodiment of a raised floor with four sets of four preformed metal sections each all bolted together, and with the floor tiles removed for the integrated skeletal frame 100 for the room. Bolt hole patterns in the raised floor section are made symmetrical and/or mirrored with respect to an adjoining section. See, for example, FIG. 19 illustrates a block diagram of an embodiment of pre-drilled bolt holes in the formed metal raised floor sections to adjoin rectangular base sections of raised floor the pre-fabricated and pre-engineered integrated skeletal frame 100 for a room. As discussed, the raised floor section rectangular shape can be formed by for the formed metal sections that come together and abut at an angle. At these angle corners, the sections of the raised floor go through precisely located bolt holes through angle brackets to adjoin with another section of the raised floor. See, for example, FIG. 13 illustrates a block diagram of an embodiment of a pre-formed metal section of the raised floor for the skeletal frame 100 for the room. FIG. 15 illustrates a block diagram of an embodiment of a cross connect section connecting between two raised floor pre-formed metal sections pre-fabricated and pre-engineered integrated skeletal frame 100 for a room. In between connections at the corners of the raised floor, a series of cross connect sections are used to give structural support to each section of raised floor as well as provide additional horizontal surfaces for mounting the wall and other structural components to. (See also for example FIG. 21) The formed metal sections of each raised floor section have channels with bolt hole predrilled into them. See also FIG. 16 illustrates a diagram of an embodiment of a cross connect beam to structurally support the pre-fabricated and pre-engineered integrated skeletal frame 100 for a room.

Figure 18:
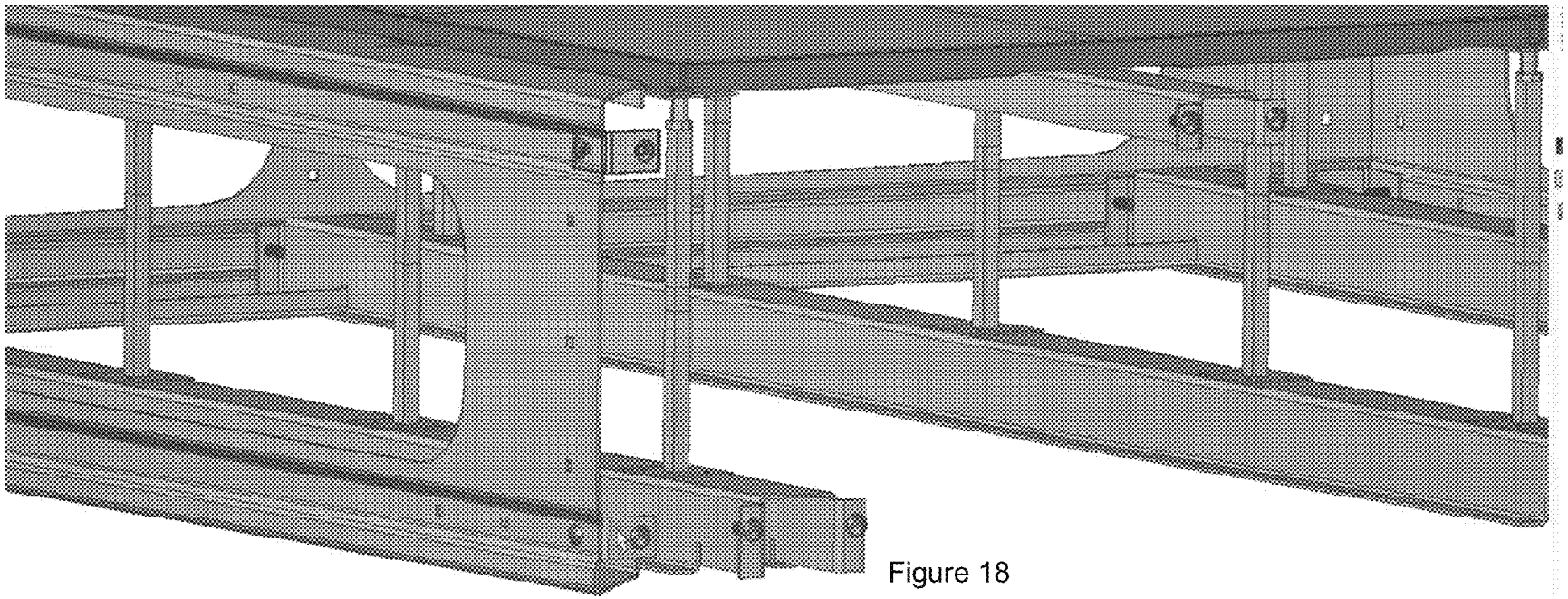
FIG. 18 illustrates a block diagram of an embodiment of mating brackets to assist in joining sections of the pre-fabricated and pre-engineered integrated skeletal frame for a room.
Figure 34:
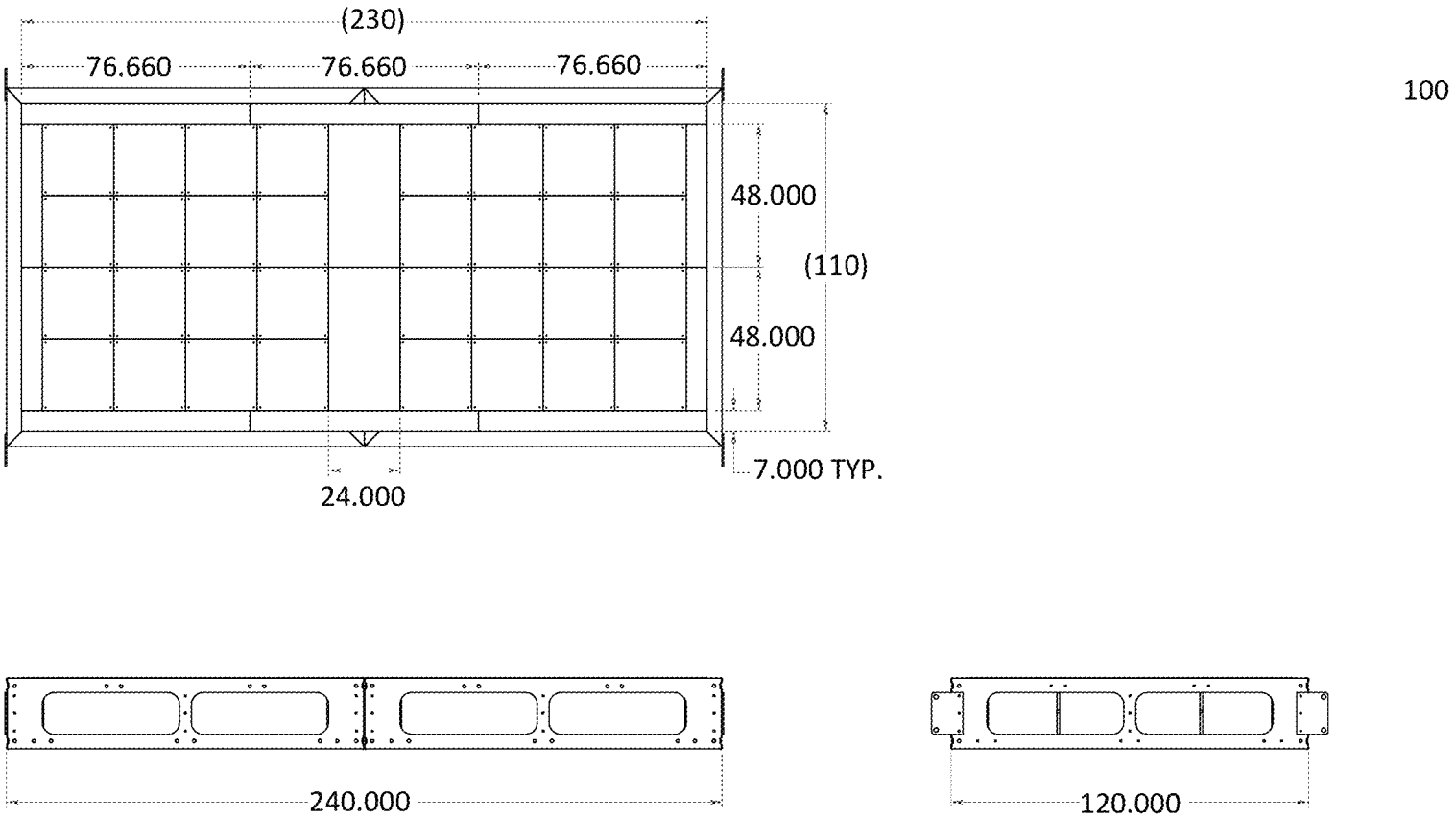
FIG. 34 illustrates a block diagram of an embodiment of a base frame with a raised floor and infill floor plates for the pre-fabricated and pre-engineered skeletal frame for a room.
Figure 35:
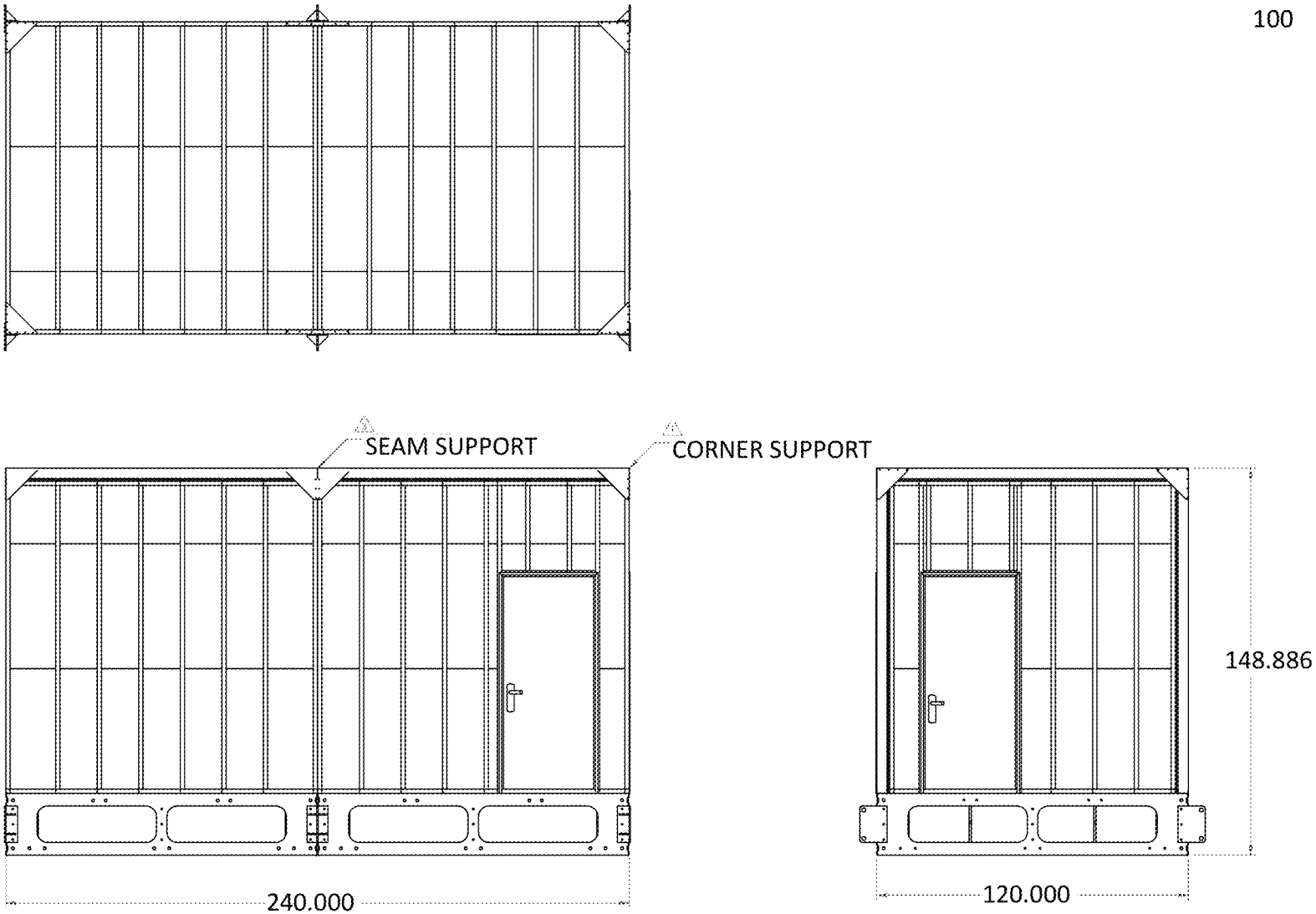
FIG. 35 illustrates a block diagram of an embodiment of brackets connecting to a first wall frame section with a door that is then adjoined to another wall frame section as well as adjoined to a roof frame section of the pre-fabricated and pre-engineered integrated skeletal frame for a room.

FIG. 18 illustrates a block diagram of an embodiment of mating brackets to assist in joining sections of the pre-fabricated and pre-engineered integrated skeletal frame 100 for a room. FIG. 34 illustrates a block diagram of an embodiment of a base frame with a raised floor and infill floor plates for the pre-fabricated and pre-engineered skeletal frame 100 for a room showing some example pre-drilled bolt/screw hole locations/patterns in the skeletal frame 100. FIG. 35 illustrates a block diagram of an embodiment of brackets connecting to an example wall frame section with a door that is then adjoined to another wall frame section as well as adjoined to a roof frame section of the pre-fabricated and pre-engineered integrated skeletal frame 100 for a room showing some example pre-drilled bolt/screw hole locations/patterns in the skeletal frame 100.

Figure 17:
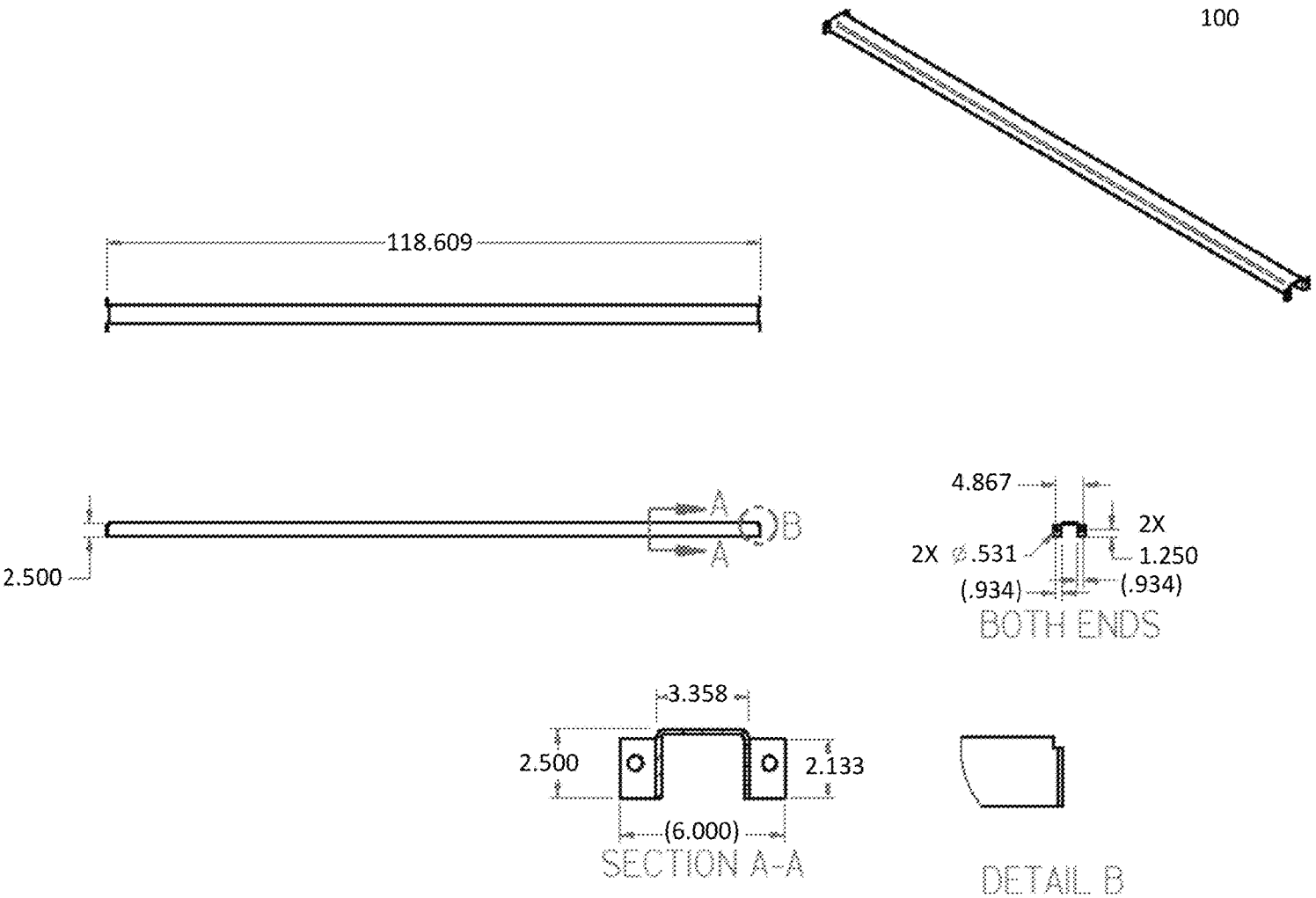
FIG. 17 illustrates a diagram of an embodiment of a cross connect structural support that spans across a roof/top of the pre-fabricated and pre-engineered integrated skeletal frame for a room.

FIG. 17 illustrates a diagram of an embodiment of a cross connect structural support that spans across a roof/top of the pre-fabricated and pre-engineered integrated skeletal frame 100 for a room. Likewise, in the middle of the channel predrilled bolt holes exist for both a top cross connect beam and a bottom cross connect beam. The predrilled bolt holes for a top cross connect beam and a bottom cross connect beam are offset with each other such that merely a top cross connect beam will easily mate up with the predrilled holes in the top channel of the raised floor section and merely the bottom cross connect beam will easily mate up with the predrilled holes in the bottom channel of the raised floor section. The bolt holes of the pre-fabricated raise floor sections including the cross connect beams are precisely measured and inserted into each of these pre-fabricated components of the raised floor so that these components may quickly connect up at the construction site.

The frame or enclosures for mounting to the frame may be fastened and torqued to the frame with screws or bolts threading through a thread hole in the framework. In certain cases, when assembled at the factory nuts can be welded to the corresponding bolt to better maintain the integrity of the assembled room during the shipping and rigging process. The mounting holes may be tapped to receive a particular type of threaded bolt. The round holes may also be large enough to permit a bolt to be freely inserted through without binding, and bolts are fastened in place using cage nuts.

Note, as discussed, the raised floor panel can have one or more channels in the exterior of that panel. The sigma shaped channel of the raised floor sections where two floor sections abut together they form a hexagon or other similar shape. The formed metal sections of the raised floor are made with sigma shaped channels so that the heads of the carriage bolts do not touch each other when the abutting and adjoining sections mate together.

As discussed, each component part can be a pre-fabricated building block that can come in standard lengths sizes. The lengths of the cross-connect beams can come in standard lengths, such as 4 foot, 5 foot, and 10 foot sections. Additionally, the outer formed sections of the raised floor can also come in standard lengths of pre-manufactured assembly such as 4 foot, 5 foot, and 10 foot. Thus, for example, each 10 foot by 10 foot raised floor section can bolt together to form a rectangular base. Another 10 foot by 10 foot raised floor section can then be attached using the sets of three predrilled bolt holes flush with the exterior of a base and not located in the channel.

Note, shims can be used to make the floor level when putting multiple raised floor rectangular bases together.

The raised floor can have a Tate type raised floor tile, which is an easily removable floor tile section, which then can support a lot of weight, wear and tear, and also provide for easy access into the raised floor area of the pre-fabricated skeletal frame 100 for the room. Again, the floor tiles may rest on the sections of the raised floor at the corners as well as on the cross connect beams.

Walls and Ceiling Sections

Figure 30:
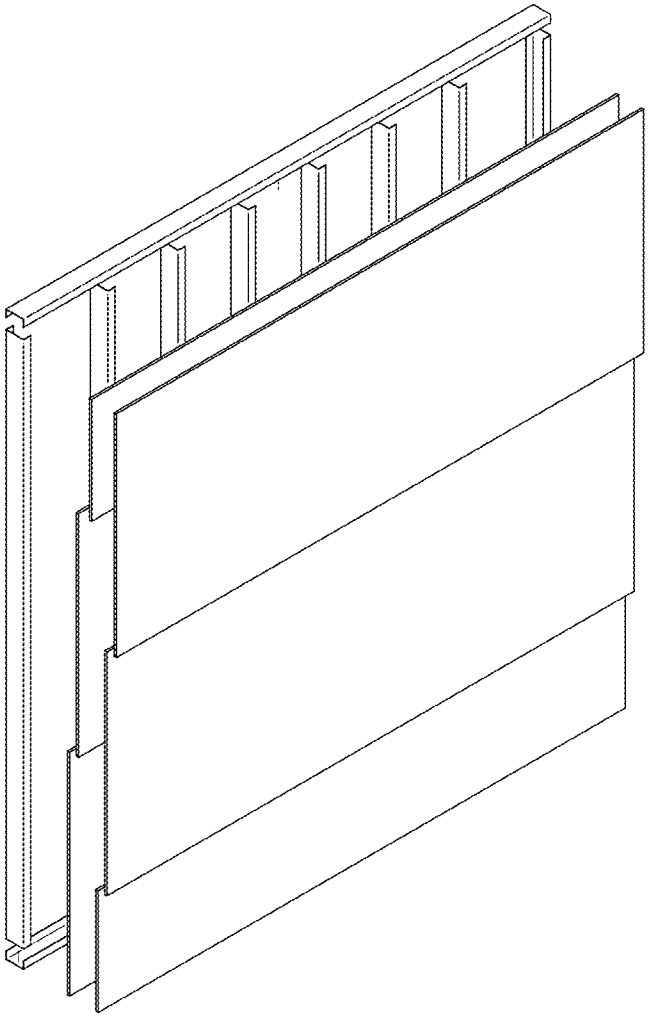
FIG. 30 illustrates an exploded view of an embodiment of a skeletal wall section with its struts and a gypsum wall panel attachable to the skeletal frame wall section with its struts forming a portion of the pre-fabricated and pre-engineered skeletal frame for a room.

FIG. 30 illustrates an exploded view of an embodiment of a skeletal wall section with its struts and a gypsum wall panel attachable to the wall frame section with its struts forming a portion of the pre-fabricated and pre-engineered skeletal frame 100 for a room. The prefabricated room has a skeletal framework 100 made up of metal and then has walls attached to that skeletal framework 100. A recessed space exists between the walls and skeletal framework 100 to run conduct and cabling for the electrical equipment and other wiring. Additionally, in an assembled electrical room the electrical panels can be mounted to the walls, with lighting attached to the ceiling, etc. The standardized sections of wall, floor, and/or ceiling can be identical to each other.

Figure 32:
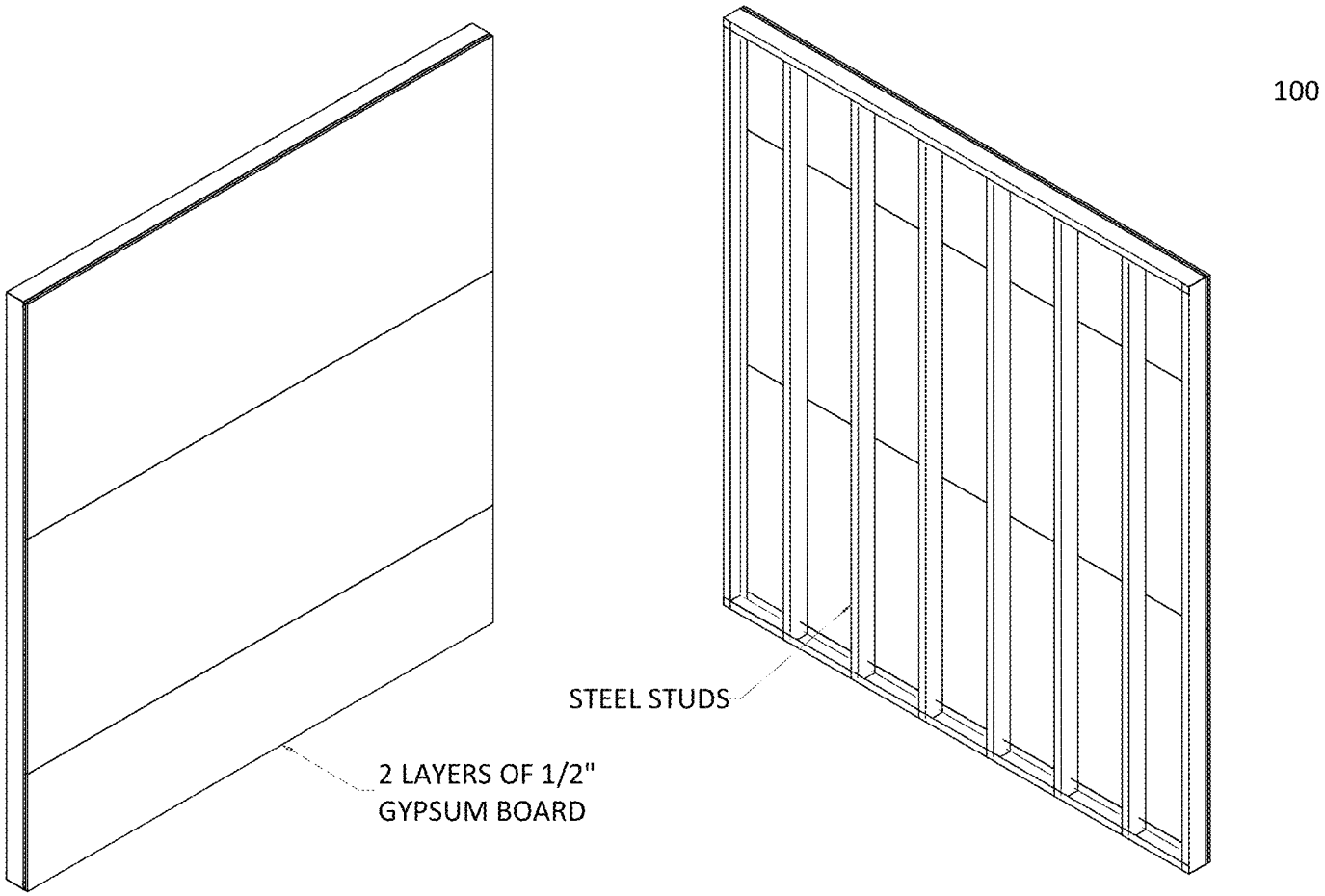
FIG. 32 illustrates an exploded view of an embodiment of a wall frame section with its struts on the right hand side and a gypsum wall panel attachable to the wall frame section with its struts forming a portion of the pre-fabricated and pre-engineered skeletal frame for a room on the left hand side.
Figure 33:
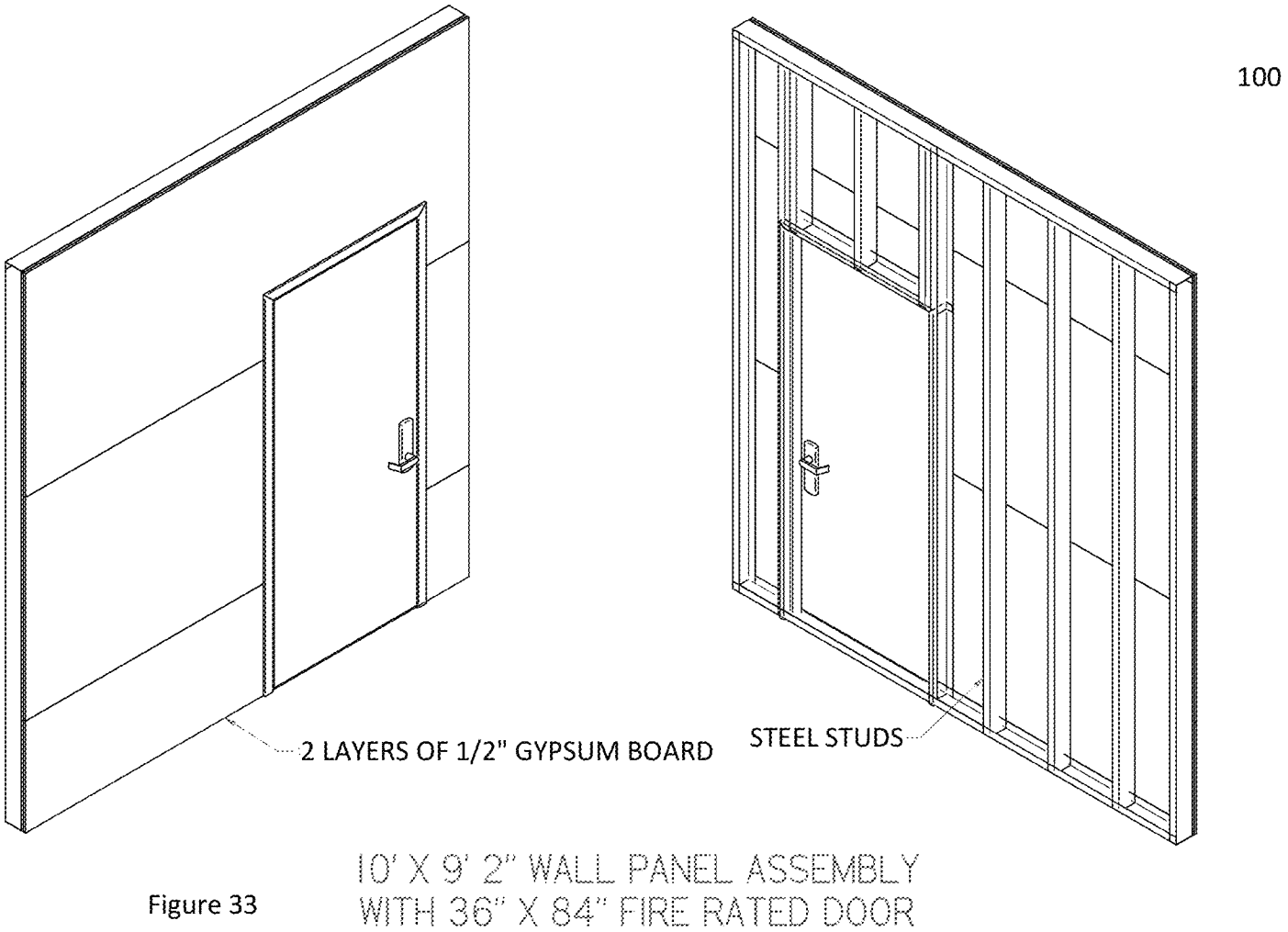
FIG. 33 illustrates a block diagram of an embodiment of the wall frame section with its struts and a reinforced fire-rated door frame in that section forming a portion of the pre-fabricated and pre-engineered skeletal frame for a room on the right hand side and an example gypsum wall attached to the wall frame on the left hand side.

Each component part is a pre-fabricated building block that can come in standard lengths sizes. The lengths of the wall and ceiling/roof sections can come in standard lengths, such as 4 foot, 5 foot, and 10 foot sections. See, for example, FIG. 32 illustrates an exploded view of an embodiment of a wall frame section with its struts on the right hand side and a gypsum wall panel attachable to the wall frame section with its struts forming a portion of the pre-fabricated and pre-engineered skeletal frame 100 for a room on the left hand side. FIG. 33 illustrates a block diagram of an embodiment of the wall frame section with its struts and a reinforced fire-rated door frame in that section forming a portion of the pre-fabricated and pre-engineered skeletal frame 100 for a room on the right hand side and an example gypsum wall attached to the wall frame on the left hand side.

The walls and ceilings of the pre-fabricated skeletal frame 100 for the room can be engineered to match up with the pre-fabricated components of the raised floor and cross connect beams. See, for example, FIG. 16.

The walls and ceilings can be prefabricated with features to easily run electrical conduit and pipes on the roof frame in the space between the roof frame and the material making up the faux ceiling for that room. Electrical conduit and pipes can be run on the exterior of the wall and/or ceiling of the pre-fabricated skeletal frame 100 for the room and then have access holes created in the wall or ceiling to allow access for the conduit and/or pipe. Also, electrical conduit and pipes and HVAC can be run in the raised floor and/or in the faux ceiling space on the roof frame. Walls can be manufactured with standard door frames and window frames. The pre-assembled wall sections can have customizations such as cut out fire rated door sections, window sections and other customizations for the structure of that wall. The walls can be pre-fabricated with the number of different types of material such as gypsum, plywood, particle board, etc. The pre-fabricated walls are made with steel studs and other steel framework. The wall sections maybe structurally tied together at the corner with corner brackets. Abutting wall sections maybe structurally tied together horizontally with seem support brackets. At least the metal wall sections can be made of a G 90 corrosion resistant/Galvanized type of metal in order to be structurally strong as well as resistance to corrosion. Advantageously, the same component of wall section can alternatively be used as a ceiling section.

Exterior Structural Support

Joist and other structural strengthening components can be run on the exterior framework of the pre-fabricated skeletal framework 100 for the room in order to make very large open rooms such as a 20×20 room without any columns being needed to support the ceiling of that room. Thus, the room has a large interior space without any columns being needed. Additionally, the walls can be manufactured in two modular height sizes such that they can made be twice as high (i.e. have steel studs/struts) for a room that is two stories high.

The skeletal frame 100 for a room has enough structural support to the entire integrated platform room structure so that it can easily be put in place by a crane and rigging process at the construction site.

Figure 3:
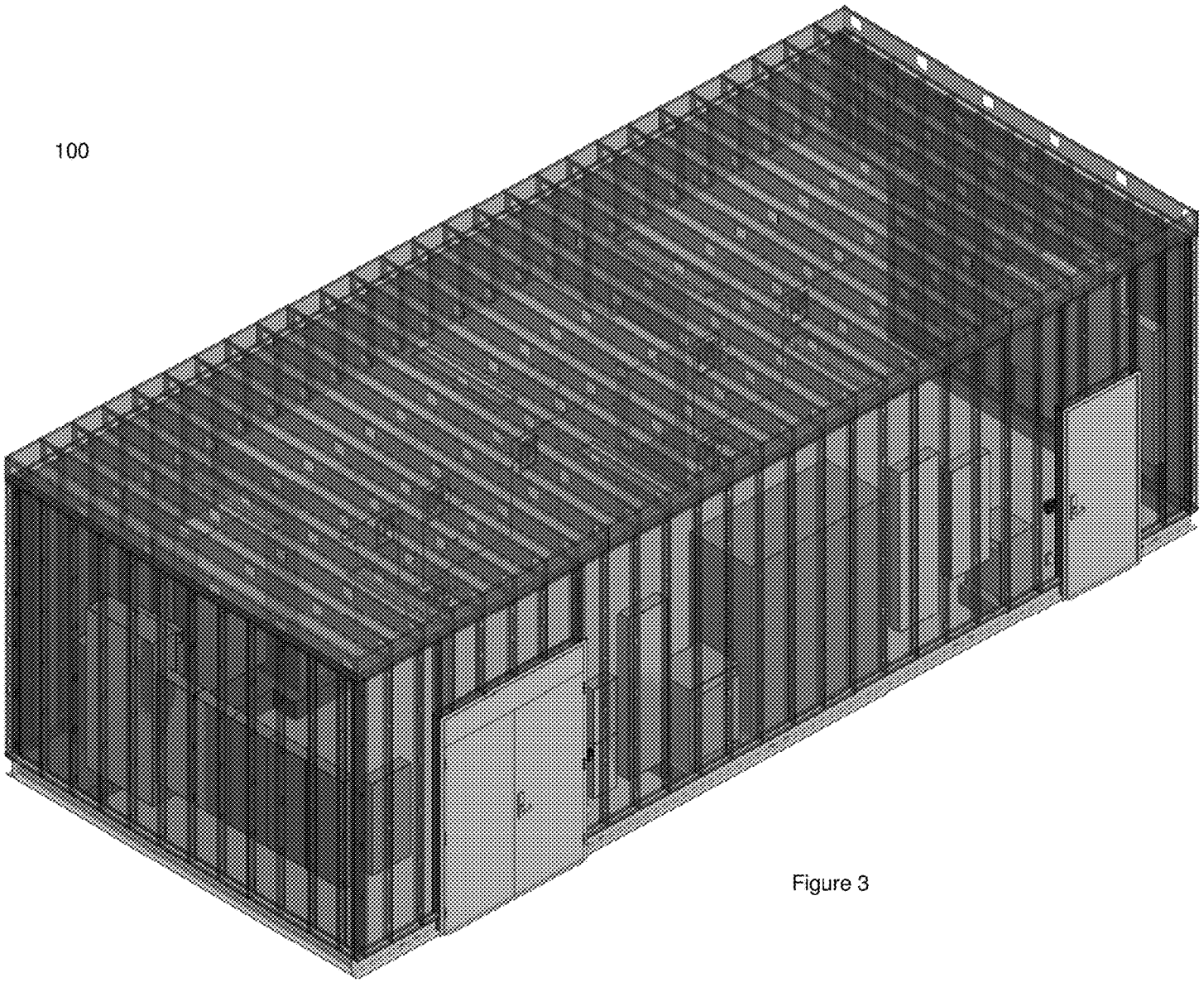
FIG. 3 illustrates a block diagram of an embodiment of a pre-fabricated and pre-engineered integrated skeletal frame for an electrical room with its electrical equipment installed, wired up, and tested offsite in a factory, as well as with the rigging lifting eye hooks, and temporary additional structural cross connect bracing for rigging removed.

FIG. 3 illustrates a block diagram of an embodiment of a pre-fabricated and pre-engineered integrated skeletal frame 100 for an electrical room with its electrical equipment installed, wired up, and tested offsite in a factory, as well as with the rigging lifting eye hooks, and temporary additional structural cross connect bracing for rigging removed. The prefabricated room can have electrical equipment mounted inside off site at the factory and then be shipped to the construction site.

The process may be as follows.

STAGE 1—RIGGING THE PRE-FABRICATED AND PRE-ENGINEERED INTEGRATED SKELETAL FRAME FOR AN ELECTRICAL ROOM FROM FACTORY ONTO TRUCK;

1. Rigging on site will be the same process and use the same additional bracing and rigging components mechanically attached to the permanent portion of the skeletal framework 100 as the rigging process onto the truck.

2. Lifting eye hooks, lifting lugs, are added bolted in place to allow for rigging of assembled portion of the room.

STAGE 2—SHIPPING THE ONE OR MORE ASSEMBLED PORTIONS OF THE ROOM ON ONE OR MORE TRUCKS FROM THE FACTORY TO THE CONSTRUCTION SITE

1. After the assembled portion of the room is rigged onto the truck, then the lifting eyes are removed to reduce the overall width.

2. The handle of the door is removed to reduce overall width.

3. D-rings are provided on the bottom of the steel to allow for tie down to truck.

4. Temporary wood floor for shipping/rigging is added and attached to the permanent portion of the skeletal frame 100 of the pre-fabricated and pre-engineered integrated skeletal frame 100 for a room.

5. Temporary shipping bracing is mechanically attached to the permanent portion of the skeletal frame 100 of the pre-fabricated and pre-engineered integrated skeletal frame 100 for a room.

STAGE 3—AFTER RIGGING THE ONE OR MORE PIECES OF THE ASSEMBLED ROOM INTO ITS FINAL PLACE IN THE BUILDING BEING CONSTRUCTED

0. The rigging process from stage 1 is performed to rig the one or more pieces of the assembled room into its final place in the building being constructed.

1. Temporary wood floor is removed.

2. Temporary shipping supports and bracing are removed.

3. When the room has been shipped in multiple portions then the multiple portions are mechanically and electrically adjoined together.

4. Handles are installed back on doors.

5. Threshold is installed to floor.

6. Assembled room is anchored to the slab of the building.

The pre-fabricated and pre-engineered integrated skeletal frame 100 for the electrical room changes the construction schedule. The electrical power to a building being constructed can be routed through the electrical equipment and wall mounted panels in the electrical room shortly after the fully assembled electrical room is rigged into place and anchored into the slab of the building. The electrical power supply to the remainder of the building need not be totally restricted to after the electrical equipment and wall panels are installed in the electrical room.

Also note, the prefabricated room has the skeletal framework 100 of the room to support the room as a free standing structure.

Figure 7:
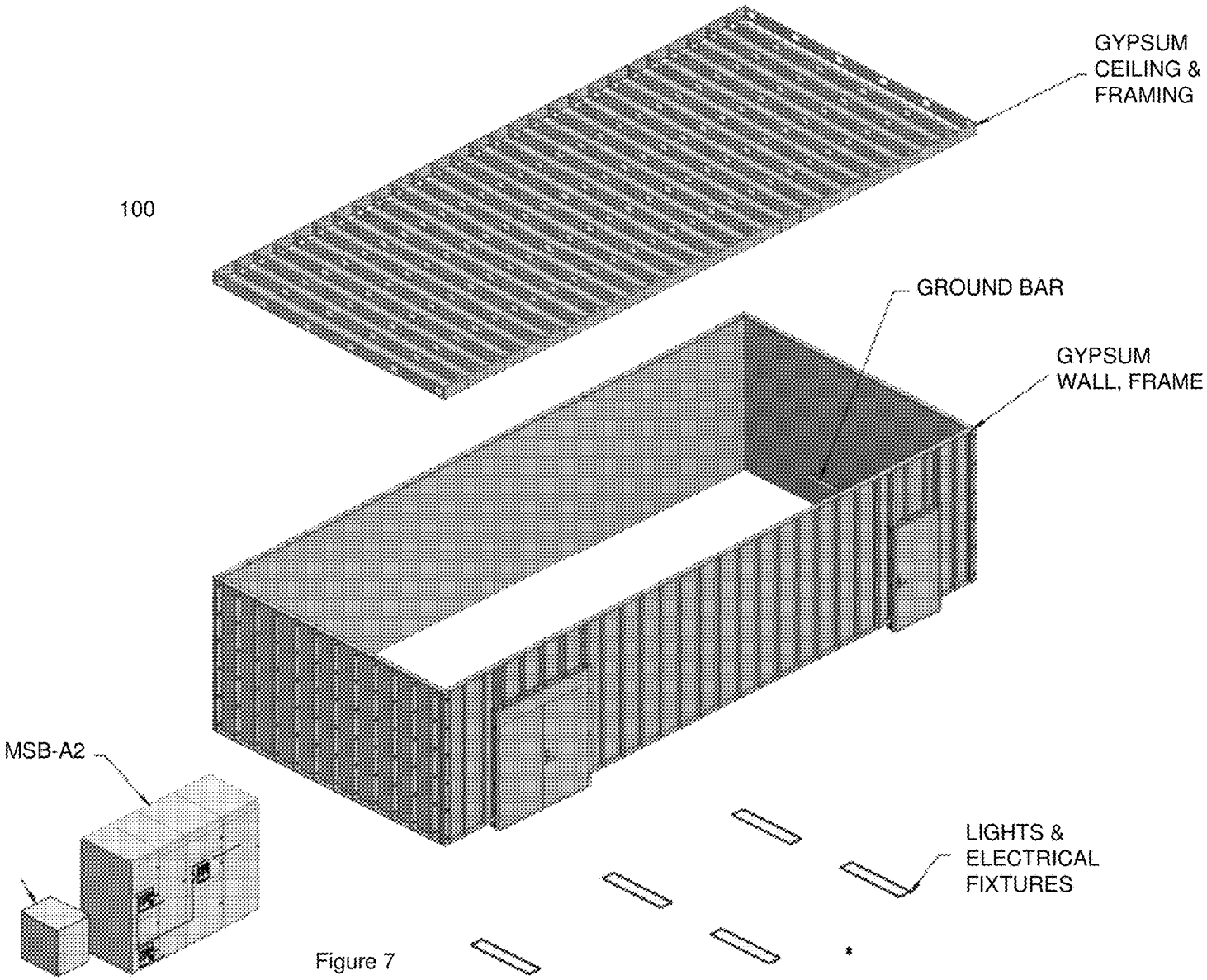
FIG. 7 illustrates an exploded view of an embodiment of the pre-fabricated and pre-engineered integrated skeletal frame for the electrical room showing the skeletal roof frame with an attached gypsum ceiling, some lighting that would be installed in the gypsum ceiling, the skeletal frame of the walls with a gypsum wall attached to the skeletal frame and some of the electrical equipment that would be installed and supported by the reinforced blocking that attaches to the skeletal frame.

FIG. 1 illustrates a block diagram of an embodiment of an assembled pre-fabricated and pre-engineered integrated skeletal frame 100 for a room with multiple skeletal sections that have a door and its door frame on a single side of the integrated skeletal frame 100 for the room and its additional rigging components attached. Note, the wall frame sections with a door can be positioned on the sides of the room as well as in the front or rear of the room. Note, some components of the assembled room can be provided and assembled by a site team or installed and assembled at the factory. FIG. 7 illustrates an exploded view of an embodiment of the pre-fabricated and pre-engineered integrated skeletal frame 100 for the electrical room showing the skeletal roof frame with an attached gypsum ceiling, some lighting that would be installed in the gypsum ceiling, the skeletal frame 100 of the walls with a gypsum wall attached to the skeletal frame 100 and some of the electrical equipment that would be installed and supported by the reinforced blocking that attaches to the skeletal frame 100.

Figure 2:
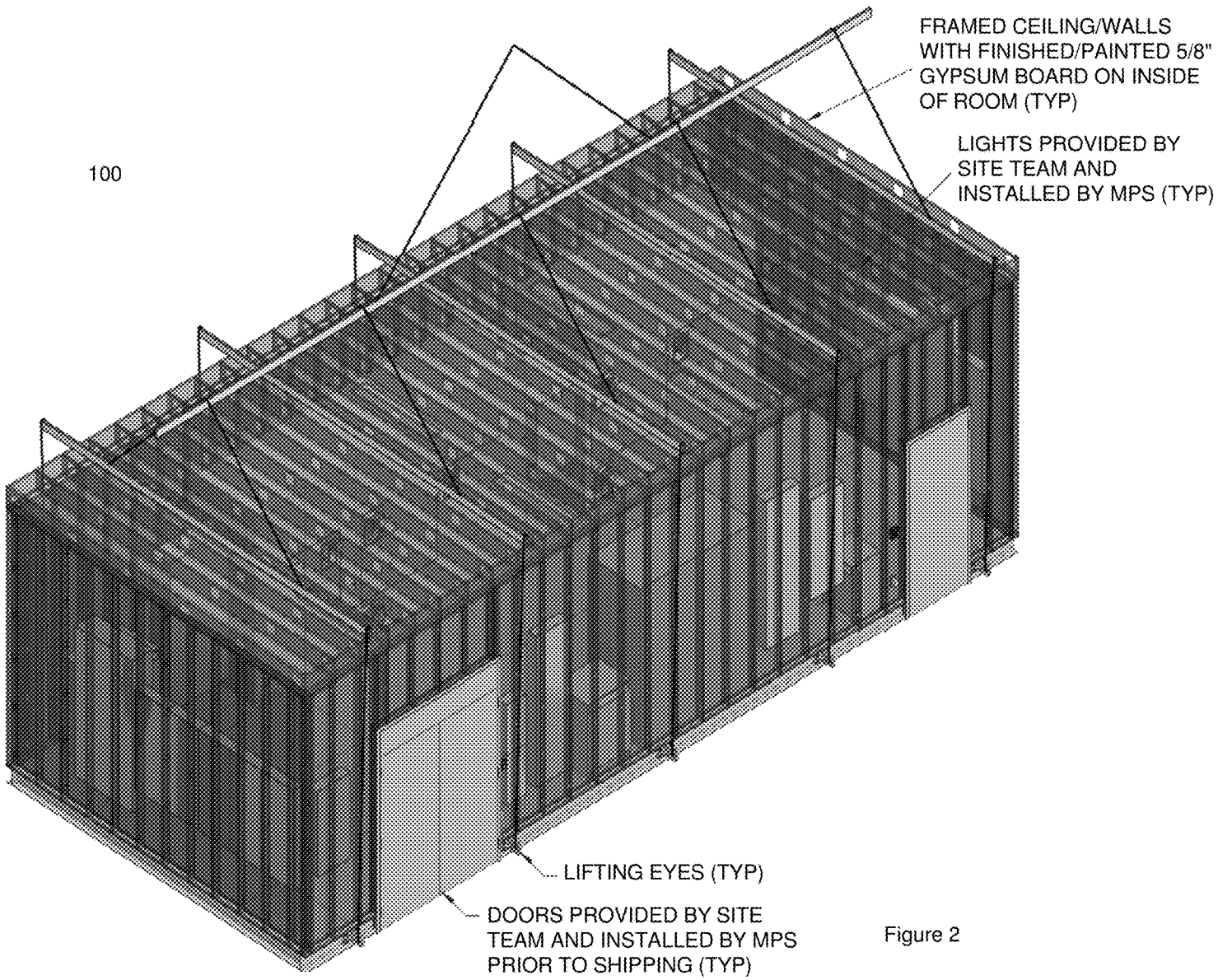
FIG. 2 illustrates a block diagram of an embodiment of an assembled pre-fabricated and pre-engineered integrated skeletal frame for a room with its rigging features, such as lifting eye hooks removable from the skeletal frame after rigging the room into a building being constructed, temporary structural cross connect bracing configured to attach to the skeletal frame to assist in maintaining structural integrity of the assembled pre-fabricated and pre-engineered integrated skeletal frame when the assembled room is shipped and rigged into place in the building that is being constructed.

FIG. 2 illustrates a block diagram of an embodiment of an assembled pre-fabricated and pre-engineered integrated skeletal frame 100 for a room with its rigging features, such as lifting eye hooks removable from the skeletal frame 100 after rigging the room into a building being constructed, temporary structural cross connect bracing configured to attach to the skeletal frame 100 to assist in maintaining structural integrity of the assembled pre-fabricated and pre-engineered integrated skeletal frame 100 when the assembled room is shipped and rigged into place in the building that is being constructed.

Figure 4:
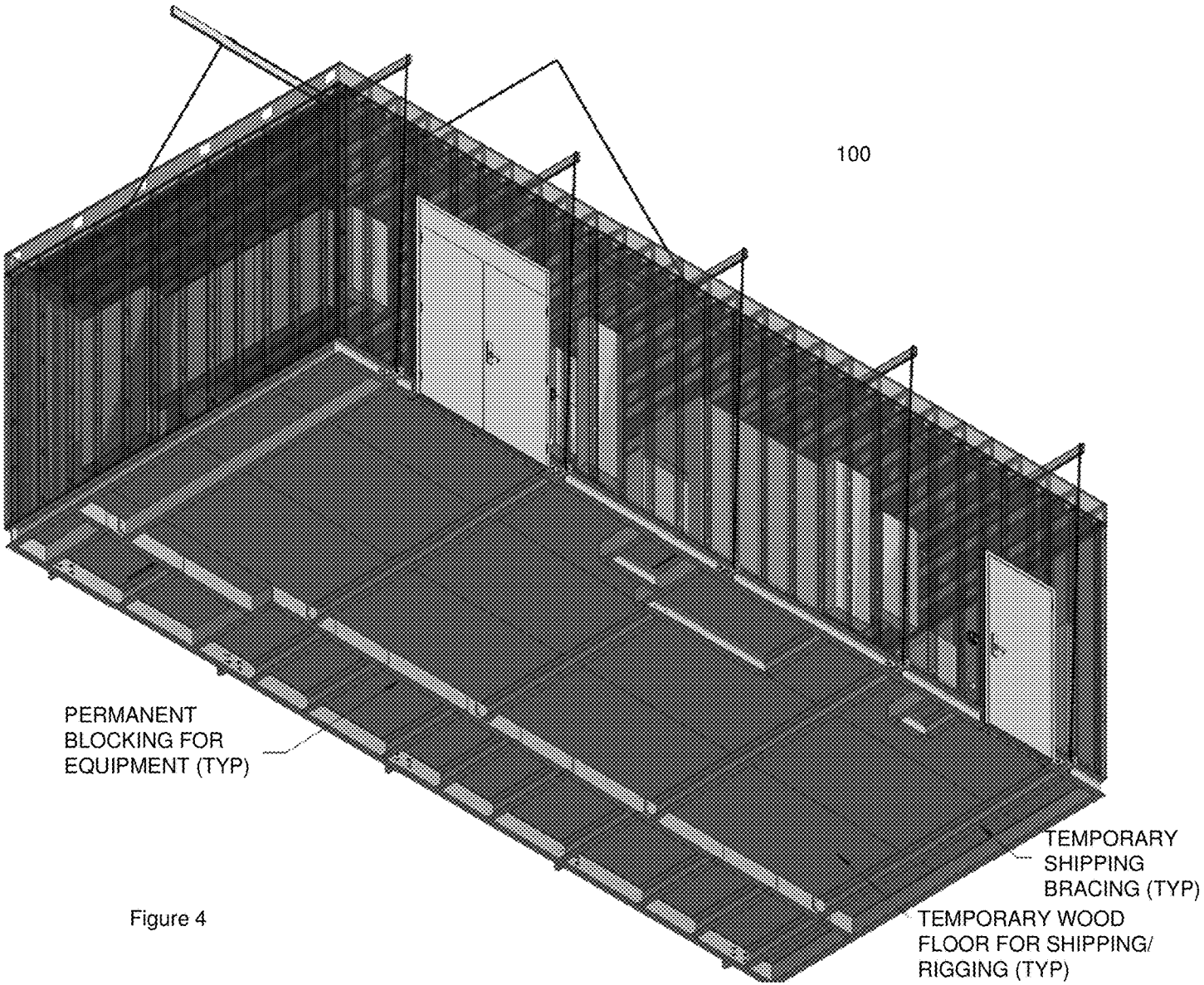
FIG. 4 illustrates a block diagram of an embodiment of a pre-fabricated and pre-engineered integrated skeletal frame for the room with its interior exposed showing temporary cross connect bracing going across the bottom of the assembled room to support at least 1.25 times the full weight of the assembled room and all of its walls and equipment installed during the shipping and rigging process, a temporary wood floor for shipping/rigging, as well as permanent reinforced blocking attached to the rest of the skeletal frame for supporting the weight of the equipment installed in the room, such as electrical equipment.

FIG. 4 illustrates a block diagram of an embodiment of a pre-fabricated and pre-engineered integrated skeletal frame 100 for the room with its interior exposed showing temporary cross connect bracing going across the bottom of the assembled room to support at least 1.25 times the full weight of the assembled room and all of its walls and equipment installed during the shipping and rigging process, a temporary wood floor for shipping/rigging, as well as permanent reinforced blocking attached to the rest of the skeletal frame 100 for supporting the weight of the equipment installed in the room, such as electrical equipment. The base of the skeletal frame 100 is all made of structural steel such as A36 steel. A set of lifting eye hooks attach to a bottom base of the skeletal frame 100 and a set of cross connect/beams go across the bottom base to support the weight and integrity of the assembled room through the hoisting with a crane and other rigging process.

Figure 5:
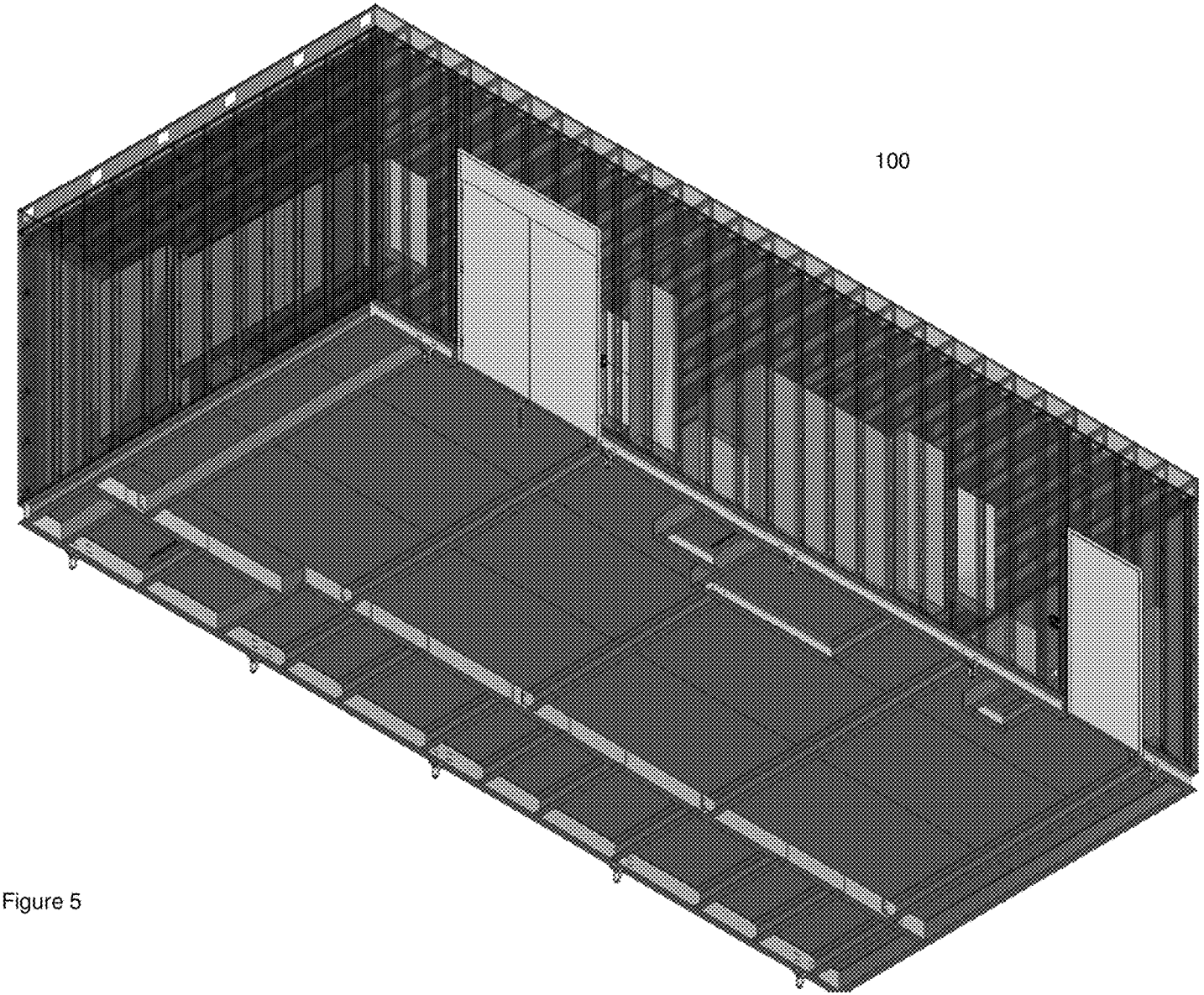
FIG. 5 illustrates a block diagram of an embodiment of the pre-fabricated and pre-engineered integrated skeletal frame for a room with multiple lifting eye hooks on the bottom base of the skeletal frame and the temporary cross connect bracing going across the bottom base for supporting the weight and integrity of the assembled room during the hoisting with a crane and other rigging processes.

FIG. 5 illustrates a block diagram of an embodiment of the pre-fabricated and pre-engineered integrated skeletal frame 100 for a room with multiple lifting eye hooks on the bottom base of the skeletal frame 100 and the temporary cross connect bracing going across the bottom base for supporting the weight and integrity of the assembled room during the hoisting with a crane and other rigging processes.

Figure 8:
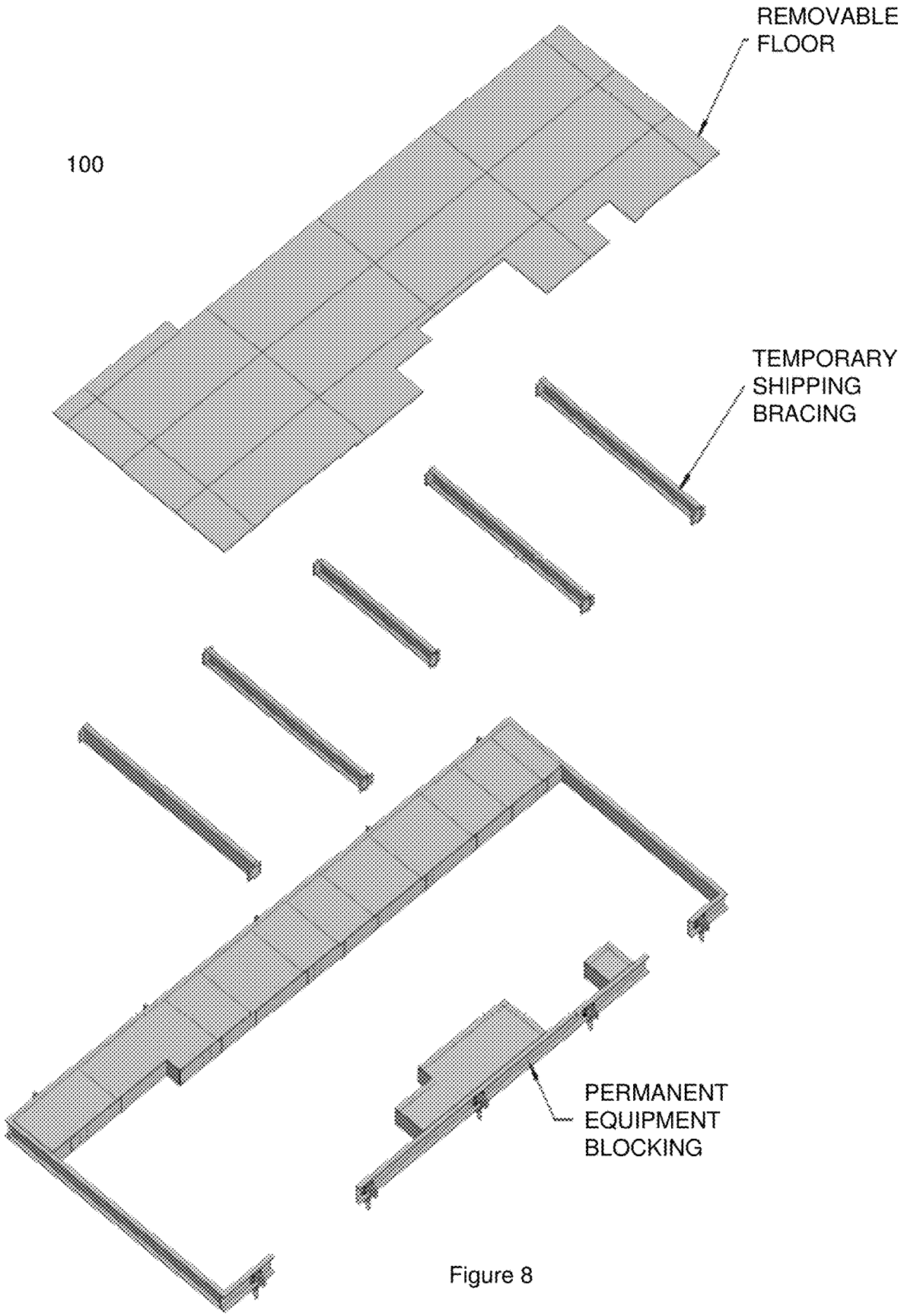
FIG. 8 illustrates an exploded view of an embodiment of the bottom of the pre-fabricated and pre-engineered integrated skeletal frame for the electrical room showing the skeletal frame with the attached reinforced blocking to support a weight of the installed equipment in the room even during the rigging process with the assistance of the cross connects for temporary shipping and rigging bracing, the cross connects for temporary shipping and rigging bracing that are designed to attach to and be removable from the skeletal frame, and a removable floor that can attach to and be removed from the skeletal frame and the blocking that supports the installed electrical equipment in the electrical room.

FIG. 8 illustrates an exploded view of an embodiment of the bottom of the pre-fabricated and pre-engineered integrated skeletal frame 100 for the electrical room showing the skeletal frame 100 with the attached reinforced blocking to support a weight of the installed equipment in the room even during the rigging process with the assistance of the cross connects for temporary shipping and rigging bracing, the cross connects for temporary shipping and rigging bracing that are designed to attach to and be removable from the skeletal frame 100, and a removable floor that can attach to and be removed from the skeletal frame 100 and the blocking that supports the installed electrical equipment in the electrical room. Also, the wood floor has attachments to be removable from the rest of the skeletal framework 100 of the room. The electrical equipment on the floor is mounted onto reinforced floor sections (e.g. equipment pads, equipment blocking) which attach to metal skeletal frame 100.

Figure 6:
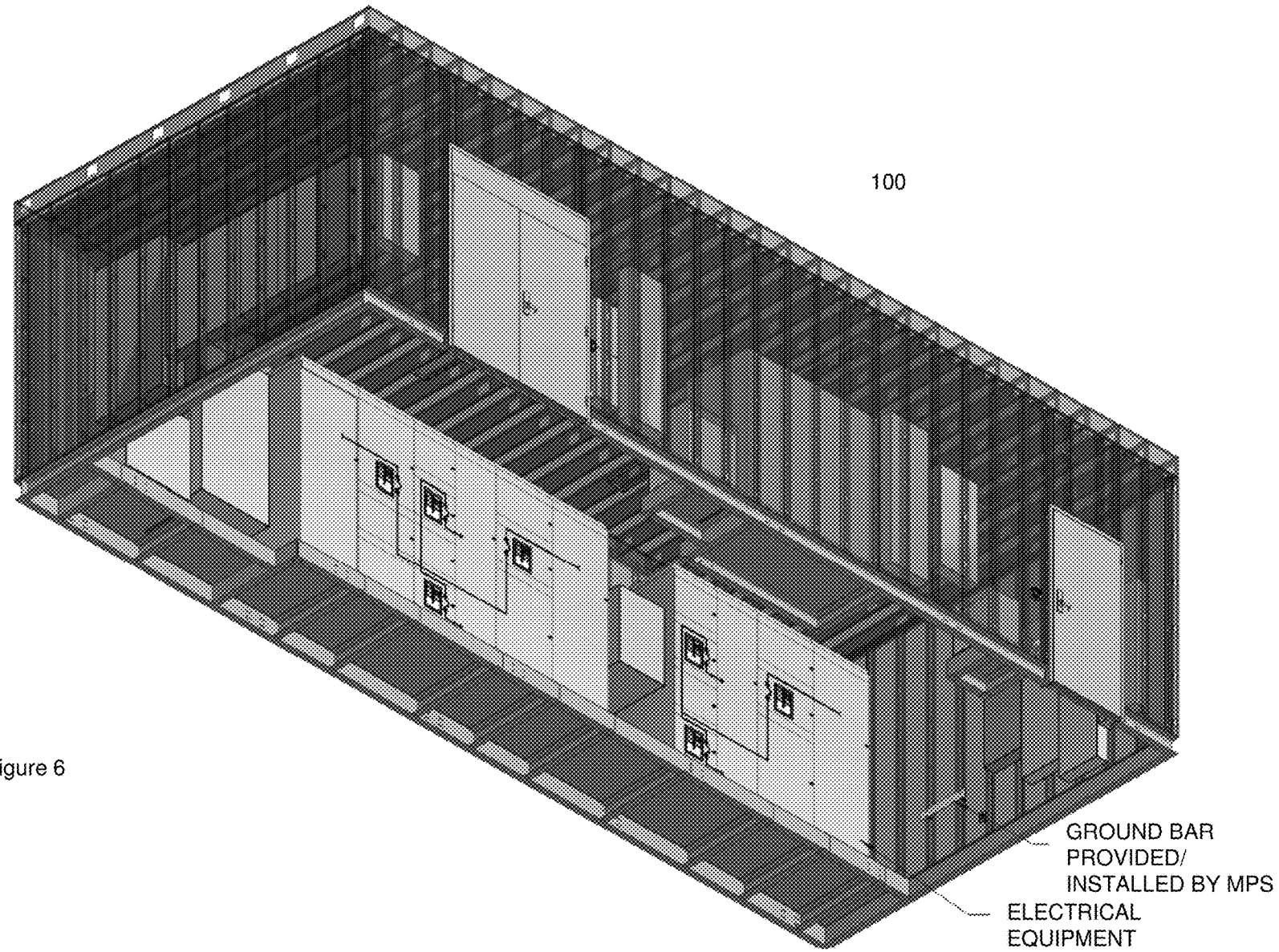
FIG. 6 illustrates a block diagram of an embodiment of the pre-fabricated and pre-engineered integrated skeletal frame for the electrical room with its interior exposed and its electrical equipment installed, rigged and installed in the building, with the removable rigging lifting eye hooks and cross connect braces removed.

FIG. 6 illustrates a block diagram of an embodiment of the pre-fabricated and pre-engineered integrated skeletal frame 100 for the electrical room with its interior exposed and its electrical equipment installed, rigged and installed in the building, with the removable rigging lifting eye hooks and cross connect braces removed.

Figure 9:
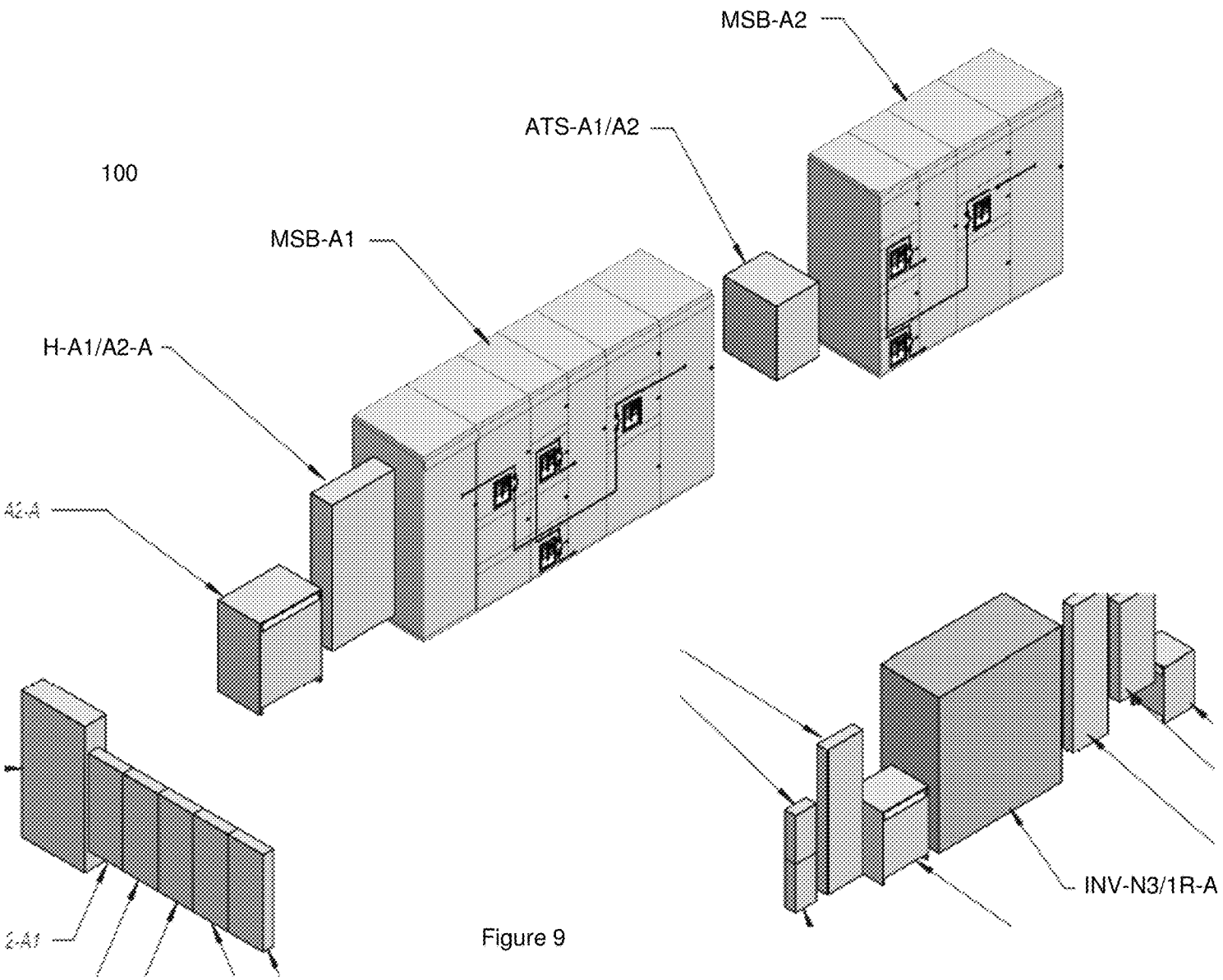
FIG. 9 illustrates an exploded view of an embodiment of an example set electrical equipment that will be installed, wired up, and tested offsite in a factory for the pre-fabricated and pre-engineered integrated skeletal frame for a room to be installed and rigged into place at the construction site. The electrical panels can be installed and wired up on the walls and the electrical cabinets and other electrical equipment that will be installed on the blocking pads.

FIG. 9 illustrates an exploded view of an embodiment of an example set electrical equipment that will be installed, wired up, and tested offsite in a factory for the pre-fabricated and pre-engineered integrated skeletal frame 100 for a room to be installed and rigged into place at the construction site. The electrical panels can be installed and wired up on the walls and the electrical cabinets and other electrical equipment that will be installed on the blocking pads. The equipment blocking is structurally reinforced for the electrical equipment to sit and rest on.

Again, the prefabricated room can come in mass fabricated pre-approved architectural sections, which can be assembled at the factory to make a room of any dimension incredibly rapidly. When the room does not match the size of pre-approved architectural section, then a single custom made section to adapt to the dimensions needed. Merely a single custom piece of structural framework needs to be fabricated while the rest of the standard components of the framework are assembled. Each of the standard components has the hole locations in the framework to attach to another portion of framework making the attachment of the custom piece very quick and easy.

Figure 10:
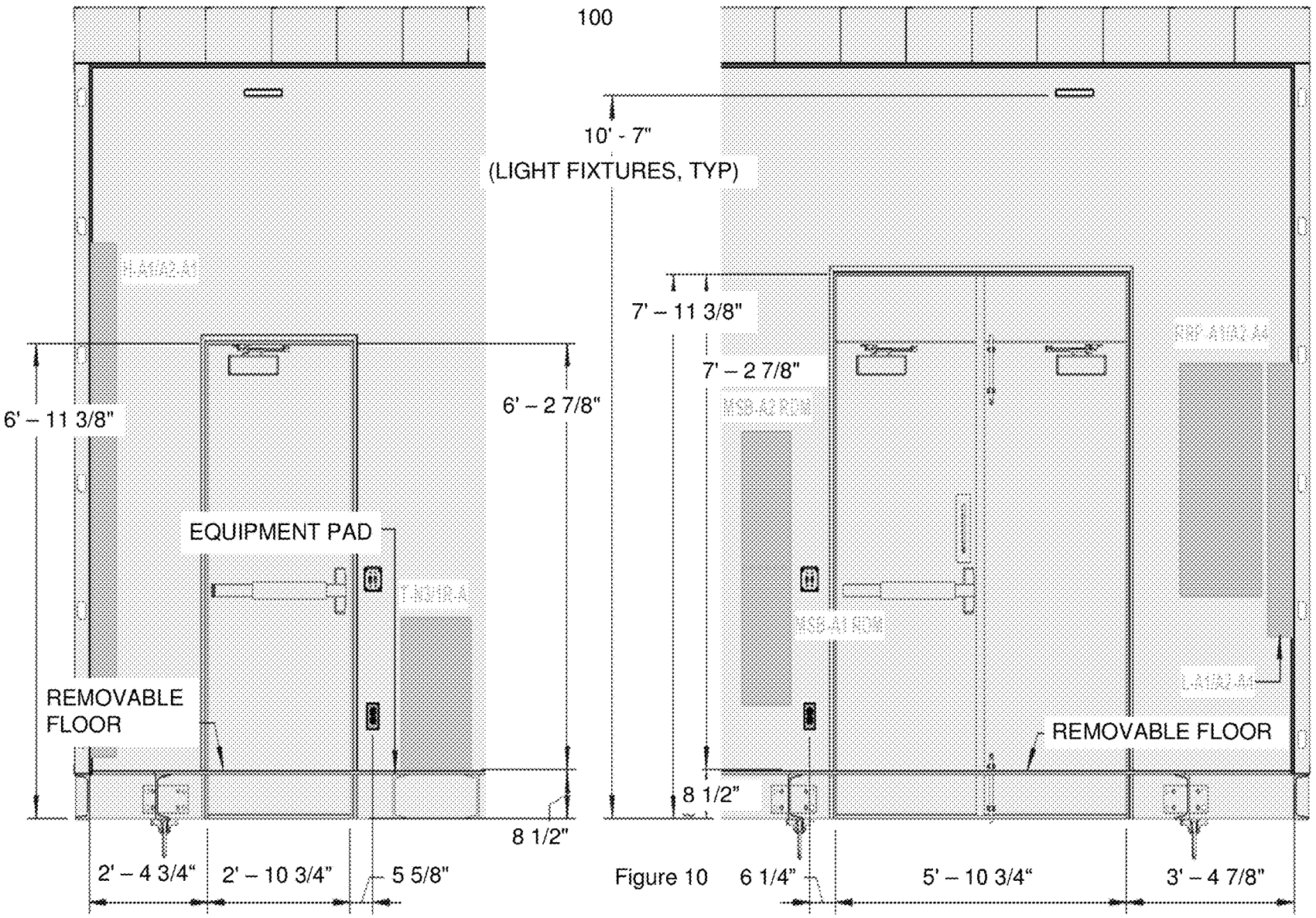
FIG. 10 illustrates a side view of an embodiment of the pre-fabricated and pre-engineered integrated skeletal frame for the electrical room showing doors installed and shaded outlines of electrical equipment mounted and installed behind the walls and door of the electrical room.

FIG. 10 illustrates a side view of an embodiment of the pre-fabricated and pre-engineered integrated skeletal frame 100 for the electrical room showing doors installed and shaded outlines of electrical equipment mounted and installed behind the walls and door of the electrical room. The frame of the door can be placed in any of the standard section making up the pre-fabricated room. The prefabricated room has the skeletal framework 100 of the room with anchor mounts built into the framework to allow the room to anchor into a concrete floor slab of a building.

While some specific embodiments of the invention have been shown, the invention is not to be limited to these embodiments. For example, most functions performed by electronic hardware components may be duplicated by software emulation. Thus, a software program written to accomplish those same functions may emulate the functionality of the hardware components in input-output circuitry. The type of cabinets may vary, etc. The invention is to be understood as not limited by the specific embodiments described herein, but only by scope of the appended claims.

We claim:

1. A pre-fabricated and pre-engineered integrated skeletal frame for a room that is manufactured to come in modular pieces that are assembled and scalable on a work site, where a first modular piece has rigging features built into that modular piece and is manufactured to be removable from a skeletal frame of the pre-fabricated and pre-engineered integrated skeletal frame after rigging the room into a building being constructed, as well as has a temporary structural cross connect bracing configured to attach to the skeletal frame to assist in maintaining structural integrity of an assembled pre-fabricated and pre-engineered integrated skeletal frame when the room as assembled is rigged into place in the building that is being constructed, where the pre-fabricated skeletal frame for the room has two or more pre-fabricated wall sections, and one or more pre-fabricated ceiling sections, which all are manufactured in standardized sections and lengths, where each modular piece is a pre-fabricated building block that comes in standard length sizes with pre-fabricated bolt holes and markings for at least one of 1) screws and 2) bolts, and where the pre-fabricated and pre-engineered integrated skeletal frame for the room has attached reinforced blocking pads that are manufactured to support a weight of the installed electrical equipment in the room even during the rigging process with the assistance of the temporary cross connect bracing and the rigging features.

2. The pre-fabricated and pre-engineered integrated skeletal frame for the room of claim 1, where the pre-fabricated and pre-engineered integrated skeletal frame for the room has multiple lifting eye hooks on a bottom base of the skeletal frame and the temporary cross connect bracing goes across a bottom base for supporting a weight and an integrity of the room as assembled during the rigging of the room as assembled into place in the building, and after the room as assembled is rigged and installed in the building, then the lifting eye hooks and the temporary cross connect braces are designed to attach to and be removable from the skeletal frame.

3. The pre-fabricated and pre-engineered integrated skeletal frame for the room of claim 1, where the pre-fabricated and pre-engineered integrated skeletal frame for the room is constructed with its electrical equipment installed, wired up, and tested offsite in a factory, and then shipped as an assembled room.

4. The pre-fabricated and pre-engineered integrated skeletal frame for the room of claim 3, where the electrical equipment that will be installed, wired up, and tested offsite in the factory for the pre-fabricated and pre-engineered integrated skeletal frame for the room to be installed and rigged into place at the work site at least includes electrical panels, electrical cabinets and other electrical equipment, where the electrical panels are installed and wired up on the pre-fabricated wall sections, and where the electrical cabinets and other electrical equipment are installed on the reinforced blocking pads.

5. The pre-fabricated and pre-engineered integrated skeletal frame for the room of claim 1, where the pre-fabricated and pre-engineered integrated skeletal frame for the room that comes to the work site in one or more shippable modular sections that are then assembled together to form a complete room structurally that is ready to be rigged into place into the building being built.

6. The pre-fabricated and pre-engineered integrated skeletal frame for the room of claim 1, where a raised floor is manufactured to be attached to the skeletal frame for the room, where pre-formed metal sections of the raised floor have pre-drilled bolt holes in the pre-formed metal raised floor sections to adjoin sections of raised floor the pre-fabricated and pre-engineered integrated skeletal frame for the room, where pre-formed metal sections of the raised floor are made with channels so that heads of bolts do not touch each other when abutting and adjoining sections mate together.

7. The pre-fabricated and pre-engineered integrated skeletal frame for the room of claim 1, where pre-marked screw locations are made in the pre-fabricated wall section to secure and join formed metal raised floor sections for the skeletal frame for the room to each pre-fabricated wall section of the skeletal frame, where a corner support bracket is used for adjoining pre-fabricated wall sections of the pre-fabricated and pre-engineered integrated skeletal frame for the room, and where a seem support bracket is used for adjoining wall sections for the pre-fabricated and pre-engineered integrated skeletal frame for the room.

8. The pre-fabricated and pre-engineered integrated skeletal frame for the room of claim 7, where a first pre-fabricated wall section has struts and a reinforced fire-rated door frame and a wall panel attached to the first pre-fabricated wall section.

9. The pre-fabricated and pre-engineered integrated skeletal frame for the room of claim 1, where the pre-fabricated and pre-engineered integrated skeletal frame has brackets connected to a first wall frame section with a door that is then adjoined to another wall frame section as well as adjoined to a roof frame section of the pre-fabricated and pre-engineered integrated skeletal frame for the room, where the wall sections and the roof frame section are prefabricated with features to run electrical conduit and pipes on the roof frame section in a space between the roof frame section and a material making up a faux ceiling for that room, where the roof frame section of the pre-fabricated skeletal frame for the room has manufactured access holes created in the roof frame section to allow access to the conduit and pipes run on the roof frame section.

10. The pre-fabricated and pre-engineered integrated skeletal frame for the room of claim 1, where the pre-fabricated and pre-engineered integrated skeletal frame for the room has the skeletal framework, which is made up of metal as well as manufactured to have the prefabricated walls sections designed to attach to the skeletal framework, where also a recessed space exists between the prefabricated wall sections and the skeletal framework to run conduct and cabling for electrical equipment and other wiring in the room as assembled, and where also one or more electrical panels are mounted to one or more of the prefabricated wall sections.

11. A method for a pre-fabricated and pre-engineered integrated skeletal frame for a room that is manufactured to come in modular pieces that are assembled and scalable on a work site, comprising:

installing a first modular piece that has rigging features built into that modular piece and is manufactured to be removable from a skeletal frame of the pre-fabricated and pre-engineered integrated skeletal frame after rigging the room into a building being constructed, installing a temporary structural cross connect bracing that is configured to attach to the skeletal frame to assist in maintaining structural integrity of an assembled pre-fabricated and pre-engineered integrated skeletal frame when the room as assembled is rigged into place in the building that is being constructed, installing the pre-fabricated skeletal frame for the room that has two or more pre-fabricated wall sections, and one or more pre-fabricated ceiling sections, which all are manufactured in standardized sections and lengths, installing each modular piece as a pre-fabricated building block that comes in standard length sizes with pre-fabricated bolt holes and markings for at least one of 1) screws and 2) bolts, and installing the pre-fabricated and pre-engineered integrated skeletal frame for the room that has attached reinforced blocking pads that are manufactured to support a weight of the installed electrical equipment in the room even during the rigging process with the assistance of the temporary cross connect bracing and the rigging features.

12. The method for the pre-fabricated and pre-engineered integrated skeletal frame for the room of claim 11, further comprising:

installing the pre-fabricated and pre-engineered integrated skeletal frame for the room that has multiple lifting eye hooks on a bottom base of the skeletal frame and the temporary cross connect bracing that goes across a bottom base for supporting a weight and an integrity of the room as assembled during the rigging of the room as assembled into place in the building, and after the room as assembled is rigged and installed in the building, then removing the lifting eye hooks and the temporary cross connect braces that are designed to attach to and be removable from the skeletal frame.

13. The method for the pre-fabricated and pre-engineered integrated skeletal frame for the room of claim 11, further comprising:

installing the pre-fabricated and pre-engineered integrated skeletal frame for the room that is constructed with its electrical equipment installed, wired up, and tested offsite in a factory, and then shipped as an assembled room.

14. The method for the pre-fabricated and pre-engineered integrated skeletal frame for the room of claim 13, further comprising:

installing the electrical equipment that is installed, wired up, and tested offsite in the factory for the pre-fabricated and pre-engineered integrated skeletal frame for the room to be installed and rigged into place at the work site, where the electrical equipment that is installed, wired up, and tested offsite at least includes electrical panels, electrical cabinets and other electrical equipment, where the electrical panels are installed and wired up on the pre-fabricated wall sections, and where the electrical cabinets and other electrical equipment are installed on the reinforced blocking pads.

15. The method for the pre-fabricated and pre-engineered integrated skeletal frame for the room of claim 11, further comprising:

installing the pre-fabricated and pre-engineered integrated skeletal frame for the room that comes to the work site in one or more shippable modular sections that are then assembled together to form a complete room structurally that is ready to be rigged into place into the building being built.

16. The method for the pre-fabricated and pre-engineered integrated skeletal frame for the room of claim 11, further comprising:

installing a raised floor that is manufactured to be attached to the skeletal frame for the room, where pre-formed metal sections of the raised floor have pre-drilled bolt holes in the pre-formed metal raised floor sections to adjoin sections of raised floor the pre-fabricated and pre-engineered integrated skeletal frame for the room, where pre-formed metal sections of the raised floor are made with channels so that heads of bolts do not touch each other when abutting and adjoining sections mate together.

17. The method for the pre-fabricated and pre-engineered integrated skeletal frame for the room of claim 11, further comprising:

installing one or more pre-fabricated wall sections with pre-marked screw locations that are made in each of the pre-fabricated wall sections to secure and join formed metal raised floor sections for the skeletal frame for the room to each pre-fabricated wall section of the skeletal frame, installing a corner support bracket that is used for adjoining pre-fabricated wall sections of the pre-fabricated and pre-engineered integrated skeletal frame for the room, and installing a seem support bracket that is used for adjoining wall sections for the pre-fabricated and pre-engineered integrated skeletal frame for the room.

18. The method for the pre-fabricated and pre-engineered integrated skeletal frame for the room of claim 17, further comprising:

installing a first pre-fabricated wall section that has struts and a reinforced fire-rated door frame and a wall panel attached to the first pre-fabricated wall section.

19. The method for the pre-fabricated and pre-engineered integrated skeletal frame for the room of claim 11, further comprising:

installing the pre-fabricated and pre-engineered integrated skeletal frame that has brackets connected to a first wall frame section with a door frame that is then adjoined to another wall frame section as well as adjoined to a roof frame section of the pre-fabricated and pre-engineered integrated skeletal frame for the room, where the wall sections and the roof frame section are prefabricated with features to run electrical conduit and pipes on the roof frame section in a space between the roof frame section and a material making up a faux ceiling for that room, and installing the roof frame section of the pre-fabricated skeletal frame for the room that has manufactured access holes created in the roof frame section to allow access to the conduit and pipes run on the roof frame section.

20. The method for the pre-fabricated and pre-engineered integrated skeletal frame for the room of claim 11, further comprising:

installing the pre-fabricated and pre-engineered integrated skeletal frame for the room that has the skeletal framework, which is made up of metal as well as manufactured to have the prefabricated walls sections designed to attach to the skeletal framework, where also a recessed space exists between the prefabricated wall sections and the skeletal framework to run conduct and cabling for electrical equipment and other wiring in the room as assembled, and installing one or more electrical panels that are mounted to one or more of the prefabricated wall sections.

* * * * *